US006231213B1

(12) United States Patent
Schmidt et al.

(10) Patent No.: US 6,231,213 B1
(45) Date of Patent: May 15, 2001

(54) DOOR FRAME FOR LENSED TROFFER

(75) Inventors: Peter Michael Schmidt, Conyers; Roger Erle Norris, Covington; John Thomas Mayfield, III, Stone Mountain, all of GA (US)

(73) Assignee: NSI Enterprises, Inc., Atlanta, GA (US)

( * ) Notice: Subject to any disclaimer, the term of this patent is extended or adjusted under 35 U.S.C. 154(b) by 0 days.

(21) Appl. No.: 09/358,378

(22) Filed: Jul. 21, 1999

(51) Int. Cl.[7] ..... F21S 8/02
(52) U.S. Cl. ..... 362/374; 362/375
(58) Field of Search ..... 362/374, 375, 362/362, 223

(56) References Cited

U.S. PATENT DOCUMENTS 2,899,542 * 8/1959 De Mauro ..... 362/374 X
3,078,366 * 2/1963 Winkler ..... 362/223
3,991,905 * 11/1976 Nicpon ..... 362/375 X
5,172,976 * 12/1992 Bogdanors ..... 362/374
5,865,532 * 2/1999 Bonazzi ..... 362/375 X
6,042,243 * 3/2000 Grill et al. ..... 362/223 X

* cited by examiner

*Primary Examiner*—Laura K. Tso
(74) *Attorney, Agent, or Firm*—Kenneth E. Darnell

(57) ABSTRACT

A door frame hingeably mounted to a lensed fluorescent troffer lighting fixture and carrying a prismatic lens cover, the door frame also integrally provides a light trap function. Structural components of the door frame have fastening elements formed integrally therewith for attachment of said components together without the use of separate fastening elements. The door frame includes low profile latching structure which allows ready opening of the door frame for relamping or other maintenance functions, hinge elements acting not only to hold the door frame to the light fixture but also to hold the door frame in a fully open position. The door frame further acts to impart rigidity to the lighting fixture when in a closed position.

79 Claims, 24 Drawing Sheets

21
23
31
33
35
37
39
41
43
45
47
51
53
55
57
75
139

DOOR FRAME FOR LENSED TROFFER

BACKGROUND OF THE INVENTION

1. Field of the Invention

The invention relates generally to lensed fluorescent troffer lighting fixtures and particularly to a combination door frame and light trap which mounts the lens cover to the fixture, the door frame being readily opened to gain access into the interior of the fixture.

2. Description of the Prior Art

Fluorescent lighting has long been commonly employed in commercial, institution and industrial applications due primarily to energy efficiencies inherent in the operation of fluorescent fixtures and the relatively low fixture cost associated with the need for large numbers of such fixtures in such applications. Fluorescent lighting fixtures suitable for such applications must also be of pleasing appearance and must provide a desired quality of light including adequate light for task lighting applications inter alia. Fluorescent lighting in the form of lensed fluorescent troffer lighting fixtures have long provided acceptable lighting solutions in office environments and the like, such applications requiring literally thousands of such lighting fixtures mounted by suspended ceiling grid arrangements and the like to provide desirable lighting performance and desirable aesthetics. Lensed fluorescent troffer lighting fixtures can also be surface mounted in those applications requiring such mounting and can provide excellent performance in such applications. In recessed applications, however, the space within which lighting fixtures are to be mounted has become increasingly smaller, these applications typically being referred to as reduced plenum installations, it being necessary to provide a fluorescent troffer lighting fixture of reduced volume and particularly of reduced depth to allow ready mounting within reduced plenums while retaining desirable performance characteristics such as minimal lamp image with desirable light outputs. Within this context, the need to provide fixtures which can be manufactured at minimum cost and high performance has increased. Such fixtures must be capable of manufacture with low material costs, low labor costs and must be capable of shipment to a job site with cost efficiencies. Once at a job site, such low-cost, high performance fixtures must be capable of rapid installation while continuing to provide ever-increasing energy efficiencies. Lensed fluorescent troffer lighting fixtures must therefore provide a marriage of aesthetic and performance considerations at minimum manufacturing and shipping costs. When in use, both grid-type and specification premium lensed fluorescent troffer lighting fixtures are seen by occupants of a space being illuminated primarily as prismatic lens covers surrounded by a reveal which in essence comprises portions of a door frame which mounts the lens cover in a desired relationship to lamping contained within the fixtures. As is commonly practiced in the industry, the door frame is structured to provide a minimum reveal consistent with appropriate mounting of the door frame to remaining portions of a fixture. Due to aesthetic considerations, latching structure which allows the door frame to be opened and thus to gain access into the interior of the fixture must be unobtrusive and preferably be of a low profile which is not perceived by an occupant of the space being illuminated. Lensed fluorescent troffer lighting fixtures also must be designed to obscure lamp images, such obscuration being a function not only of a prismatic lens cover but also of the fixture itself. Use of T8 lamping and relatively low profile electronic ballasts facilitate the design of lensed troffers of lesser height dimensions and which are capable of mounting within reduced plenum situations. Fixtures of this type must be provided with door frames of relatively low profile and which are configured to avoid the use of separate fastening elements in the manufacture of the door frame. Further, light leaks about interfaces between the housings of lensed troffer fixtures and door frames must be prevented in order to provide a desirable appearance. A door frame for a lensed troffer fixture must also be readily openable by manipulation of latches which are available for manual manipulation from beneath the fixture while being visually unobtrusive. On opening of a door frame for a lensed troffer fixture, it is further desirable for the door frame carrying the lens cover to remain in place and attached to remaining portions of the fixture during the time when access to the interior of the fixture is necessary such as for relamping or other maintenance.

An example of a lensed fluorescent troffer lighting fixture is seen in U.S. Pat. No. 3,045,577 to Lazerson. Lazerson describes a door frame which carries a lens cover. Lazerson does not provide structural components comprising a door frame which can be assembled together by means of fastening elements integrally formed with the structural components. In U.S. Pat. No. 3,988,609, Lewin describes lensed troffer lighting fixture including a lighting panel or prismatic lens cover described as exhibiting substantial efficiencies, the fixture itself apart from the lens cover not being improved relative to the prior art.

In U.S. Pat. No. 5,823,663, Bell et al describe a fluorescent troffer lighting fixture and particularly a parabolic troffer formed of a housing assembly comprising structural components capable of snap-fit assembly. Kaiser et al, in U.S. Pat. No. 5,806,972, describe a light trap and louver mounting arrangement useful with the housing assembly disclosed in the Bell et al patent. The parabolic troffers disclosed by Bell et al and Kaiser et al relate to the present lensed fluorescent troffers only in the similar concept of providing structure capable of snap-fit assembly without the need for separate fasteners, the particular structures of the present lensed troffers including the present door frame and light trap combination differing from corresponding structures as disclosed in the Kaiser et al and Bell et al patents.

The invention thus provides a door frame for a lensed fluorescent troffer lighting fixture wherein the door frame is capable of snap-fit assembly of structural body elements without the need for separate fasteners. The structural body elements of the invention which form the present door frame and light trap combination are provided with fastening elements which are integral with the body elements, thereby yielding savings in material costs as well as in assembly costs while providing a door frame and light trap combination having excellent mechanical performance as well as being aesthetically pleasing and which can be mounted to fixture housing assemblies of varying description including housing assemblies of lensed troffer lighting fixtures formed with a minimum depth to allow installation in reduced plenum environments while retaining desirable performance characteristics including reduction of lamp image and production of desired illumination levels. The door frame of the invention provides necessary functions such as the mounting of a prismatic lens cover to a housing assembly of a lensed troffer fixture while also providing a light trap function, the present door frame being readily manufactured at low cost while being capable of pleasing appearance when in use.

SUMMARY OF THE INVENTION

The present invention provides a door frame and light trap combination comprising a portion of a lensed troffer lighting fixture, the door frame being capable of assembly from component parts amenable to automated fabrication. The component parts of the door frame and light trap combination are assembled together without the use of separate fasteners, the resulting assembly being characterized by simplicity and economy of construction. The door frame further imparts rigidity to a lensed troffer fixture when in an assembled relationship with a housing assembly of a lensed troffer according to the invention. The rigidity of the lensed troffer fixture having the present door frame and light trap combination mounted thereto allows excellent lighting performance due to retention of component parts of the fixture in place relative to each other. The ability of the component parts of the door frame and light trap combination to retain a precise fitting of said parts allows rough handling of the structure during installation and retains necessary performance after installation.

The door frame and light trap combination of the invention mounts a lens cover such as a prismatic light panel in place relative to remaining portions of a lensed troffer fixture, component parts of the door frame including cooperating fastening elements formed integrally with the component parts being capable of inordinately rapid and ready assembly of said component parts to form the door frame and light trap combination. The integral fastening elements formed on said component parts are configured to allow snap-fastening of the component parts together in a manner which assures a locking together of the component parts which is reliable and precise. The door frame and light trap combination configured according to the invention is therefore capable of rapid and easy assembly without the use of separate fastening elements. The door frame and light trap combination of the invention is further provided with latching elements which allow opening and closure of the door frame by simple manipulation of the latch elements and particularly through simple finger pressure on a visible portion of the latch elements. Release of the door frame by the latch elements allows pivoting of the door frame and light trap combination about one edge thereof due to the provision of hinging elements which releaseably connect the door frame and lens cover carried thereby to remaining portions of the fixture, the hinge elements further allowing continued attachment of the door frame to the fixture at full pivoting extension of the door frame relative to remaining portions of the fixture without the need for manual intervention of a user to maintain the door frame and lens cover carried thereby in place when access to the interior of the fixture is necessary such as for relamping or other maintenance.

Accordingly, it is an object of the invention to provide a door frame and light trap combination for a lighting fixture such as a lensed troffer lighting fixture and which is capable of superior mechanical efficiency even though being rapidly assembled from component parts which can be fabricated using standard automated fabrication techniques.

It is a further object of the invention to provide a door frame and light trap combination for a lighting fixture and particularly a lensed fluorescent troffer lighting fixture which can be assembled through the expedient of fastening elements formed integrally with component parts of the door frame, the door frame thus being capable of rapid and economical assembly from component parts which can be fabricated using standard automated fabrication techniques.

It is a further object of the invention to provide a door frame and light trap combination particularly intended for use as a part of a lensed fluorescent troffer lighting fixture and wherein the door frame can be rapidly and efficiently assembled without the need for separate fasteners.

Further objects and advantages of the invention will become more readily apparent in light of the following detailed description of the preferred embodiments.

DESCRIPTION OF THE PREFERRED EMBODIMENTS

Figure 1:
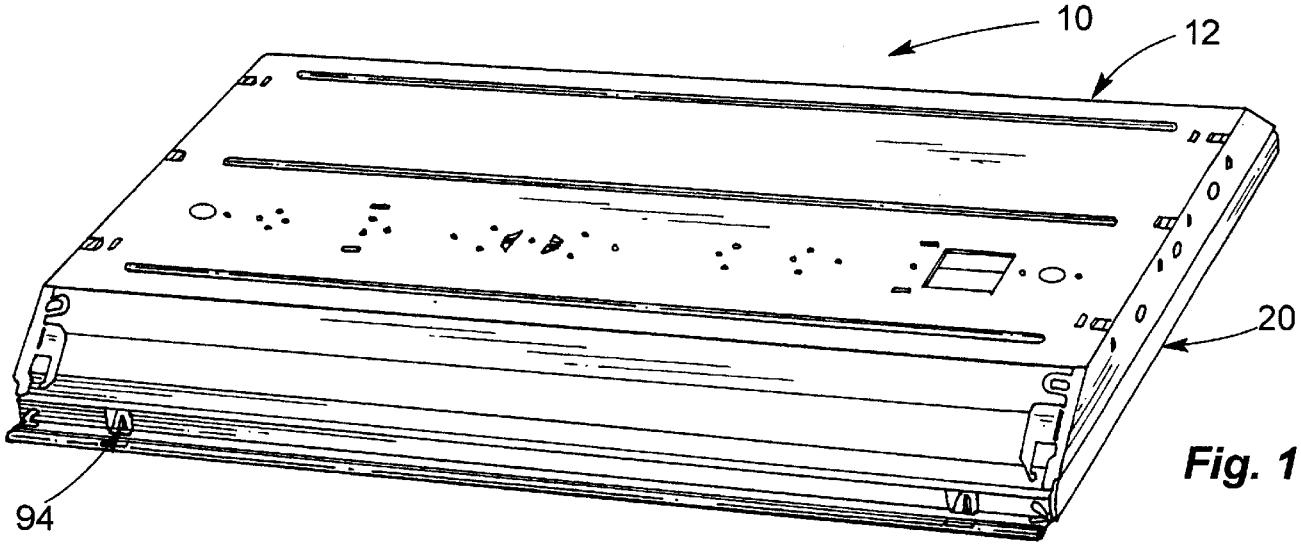
FIG. 1 is a perspective view from above and to one end of a lighting fixture provided with a door frame and light trap assembly configured according to the invention.

Reference is made to copending U.S. patent application Ser. No. 09/358,376, entitled "Lensed Troffer Lighting Fixture", assigned to the present assignee and filed of even date, the disclosure of said patent application being incorporated hereinto by reference. Reference is also made to copending U.S. patent application Ser. No. 09/298,298, entitled "Inverted Apex Prismatic Lens", assigned to the present assignee and filed Apr. 23, 1999, the disclosure of said patent application being incorporated hereinto by reference.

Referring now to the drawings and particularly to FIGS. 1 through 9, a lighting fixture configured according to the invention is seen generally at 10, the fixture 10 as shown being a lensed fluorescent troffer lighting fixture intended to mount elongated fluorescent lamps as will be described herein. The fixture 10 comprises a housing assembly 12 and a door frame and light trap assembly 14, referred to hereinafter as the door frame 14, the housing assembly 12 being described in detail in copending U.S. patent application Ser. No. 09/358,376, entitled "Lensed Troffer Lighting Fixture" mentioned above. The door frame 14 carries prismatic lens cover 16 and maintains said lens cover 16 in an appropriate spatial relationship relative to lamping carried within the housing assembly 12. The housing assembly 12 comprises inter alia a housing channel 18 and end plates 20 respectively connected to each end of the housing channel 18 and mounted thereto by fastening elements integrally formed on said housing channel 18 and on said end plates 20, the end plates 20 being connected securely to the housing channel 18 without the need for separate fastening elements as is described in the aforesaid copending patent application Ser. No. 09/358,376.

Figure 2:
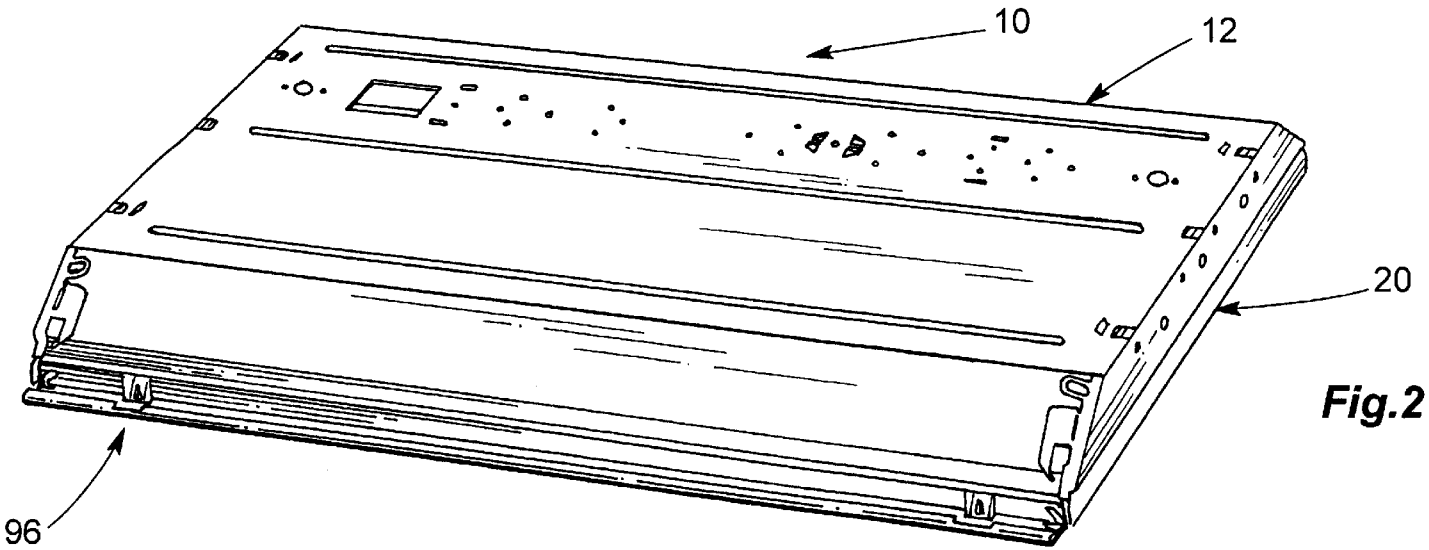
FIG. 2 is a perspective view of the lighting fixture of FIG. 1 taken from the other side thereof.
Figure 3:
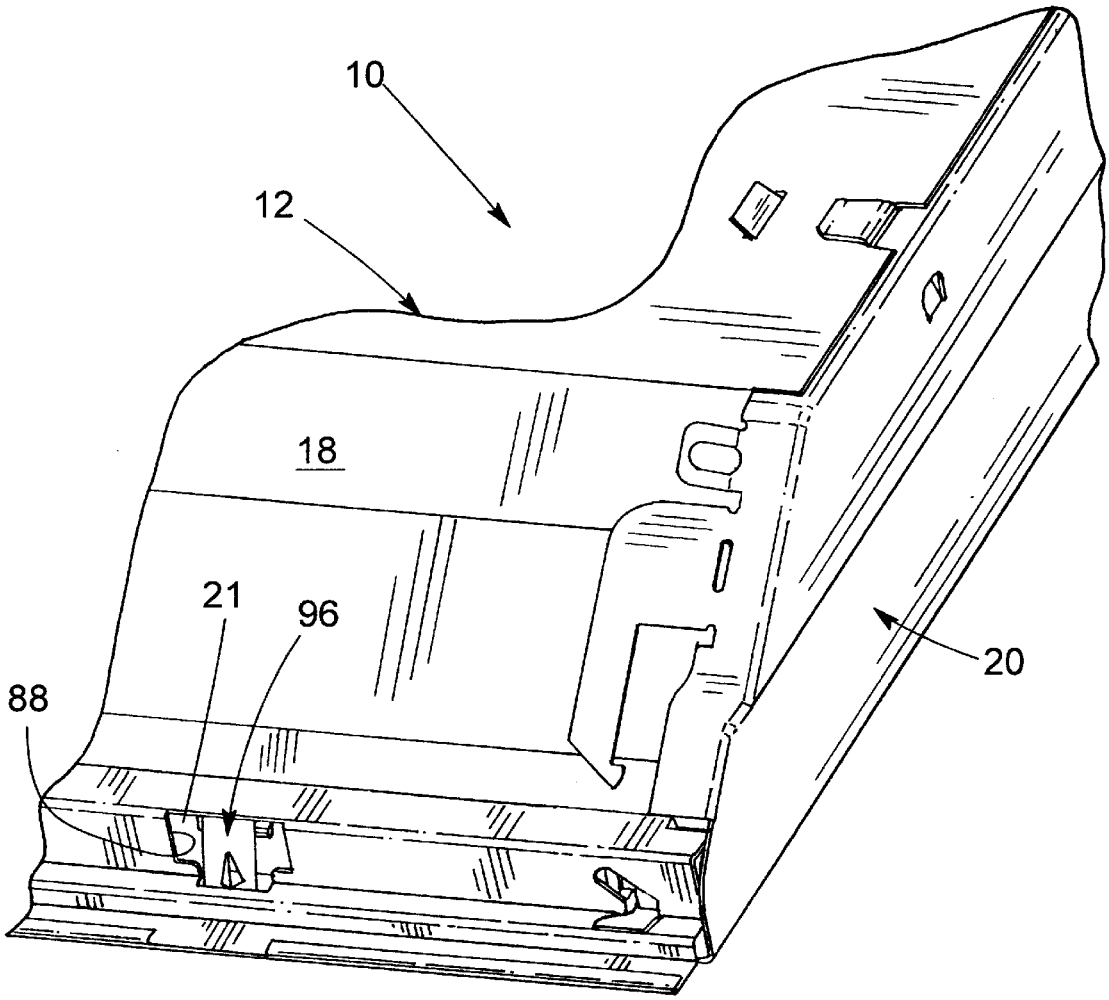
FIG. 3 is a detail perspective view of one corner of the lighting fixture of FIG. 2.

As particularly seen in FIGS. 2 and 3, the door frame 14 is mounted to the housing assembly 12 with portions of one each of the latching elements 96 extending from shaped slots 88 formed in the housing assembly 12. In FIG. 3, each of the latching elements 96 is seen to be located at one of the respective ends of the fixture 10. FIG. 16 provides more detailed views of the latch 96. While a portion of a side structural bar 21 can be seen in FIG. 3 through the slot 88, the remaining portions of the door frame 14 cannot be seen in FIGS. 2 and 3 since the housing assembly 12 hides the door frame 14 in these figures. As will be described hereinafter, a portion of the latching element 96 intended to be manually manipulated to release the door frame 14 from the housing assembly 12 extends outwardly of the fixture 10 through a lower portion of the slot 88 so as to be accessible for its intended use.

Figure 4:
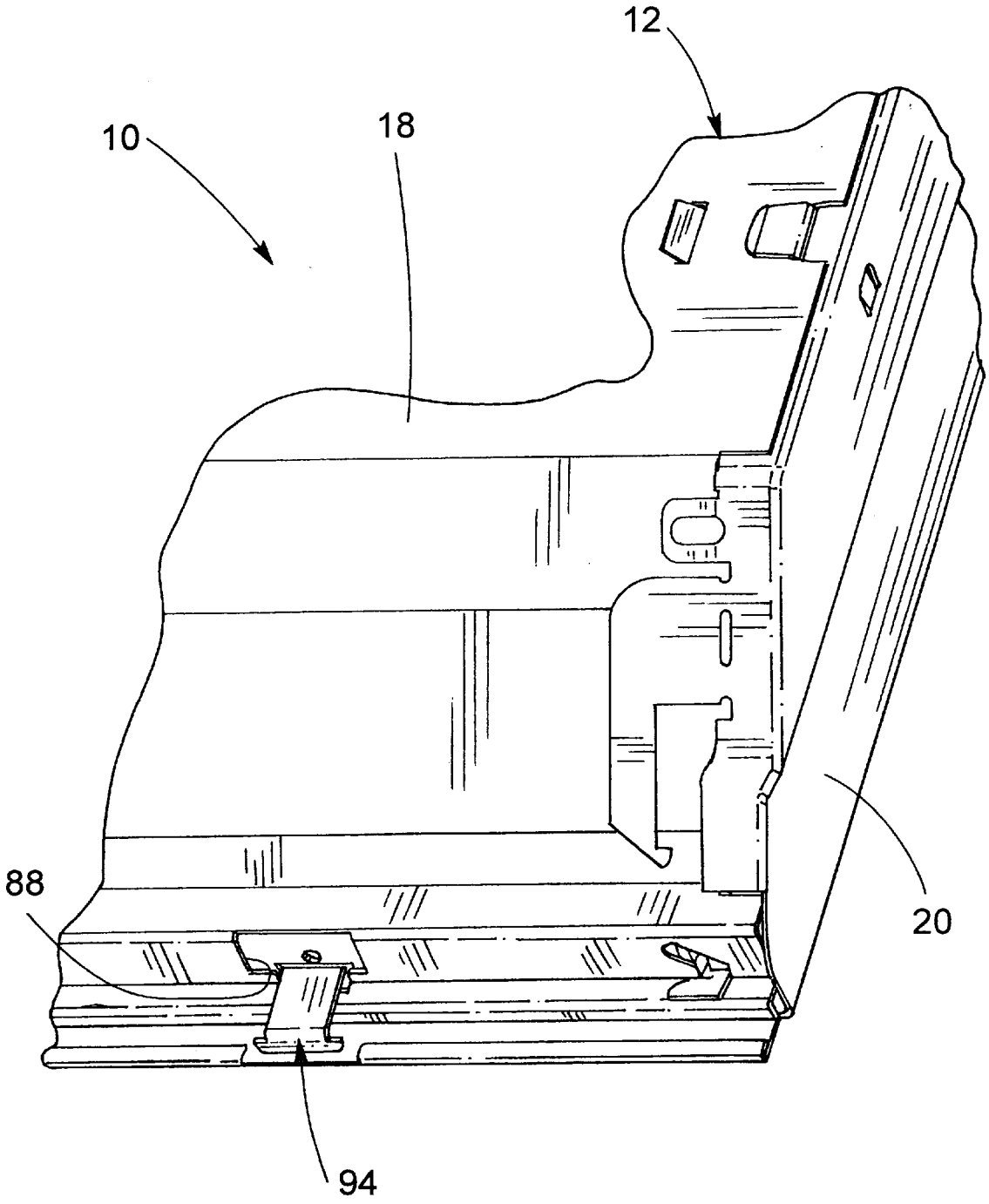
FIG. 4 is a detail perspective view of a corner of the lighting fixture as seen in FIG. 1.

FIGS. 1 and 4 show the fixture 10 from the other side thereof, the other side of the fixture 10 being that side which is hinged by means of hinge elements 94 which are connected to side structural bar 23 as will be described hereinafter. As is best seen in FIG. 4, a portion of the hinge element 94 extends through a slot 88 formed in the housing assembly 12. In essence, the door frame 14 is not visible in FIGS. 1 and 4. The slots 88 formed in the housing channel 18 on the side thereof on which the hinge elements 94 are mounted are essentially identical with the slots 88 formed along the opposite side edge of the channel 18 for mounting the latching elements 96, one each of the slots 88 being located near each end of the housing assembly 12 along each side thereof.

Figure 5:
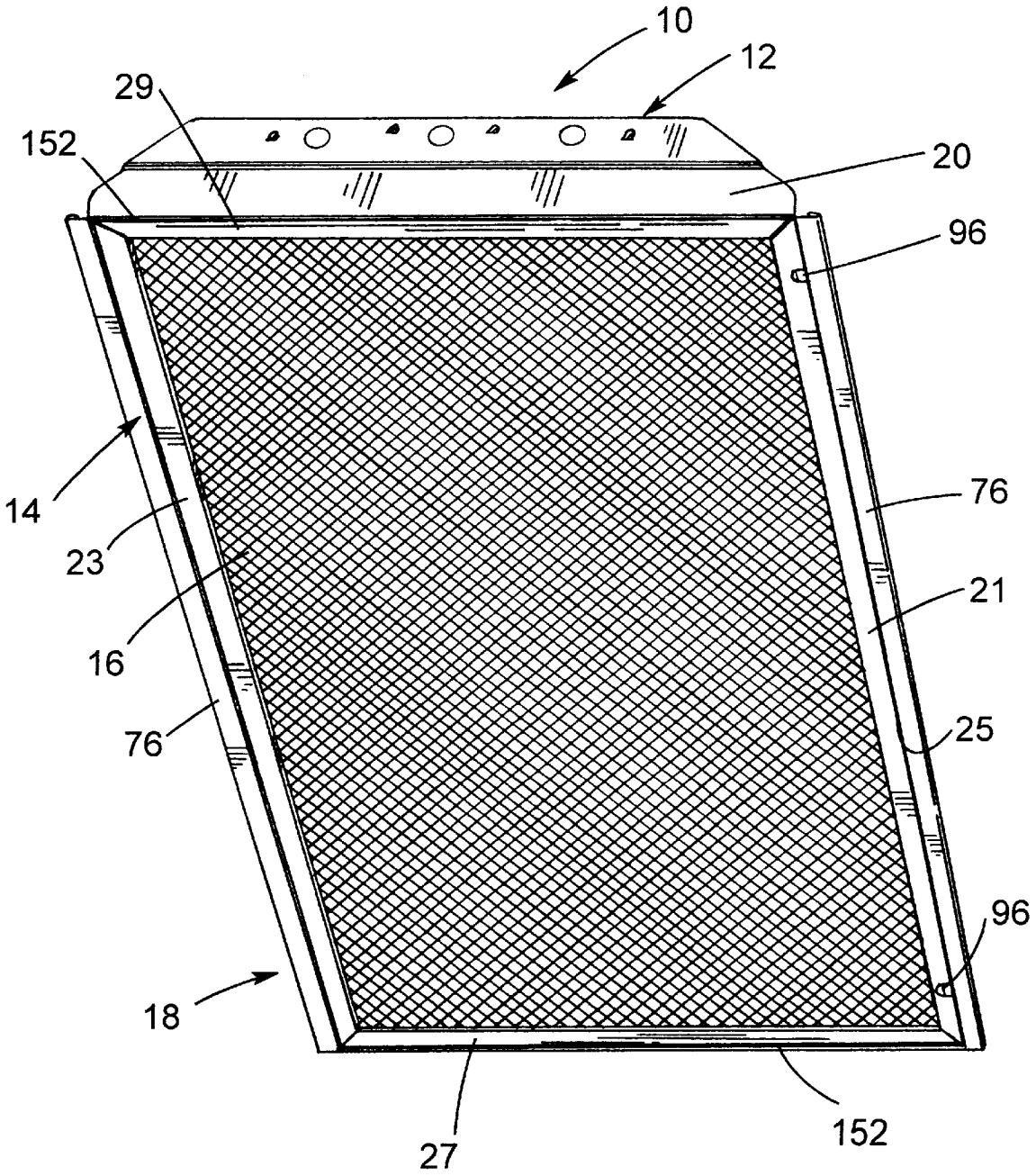
FIG. 5 is a perspective view of the lighting fixture of FIG. 2 taken from beneath and to one side of the fixture.
Figure 6:
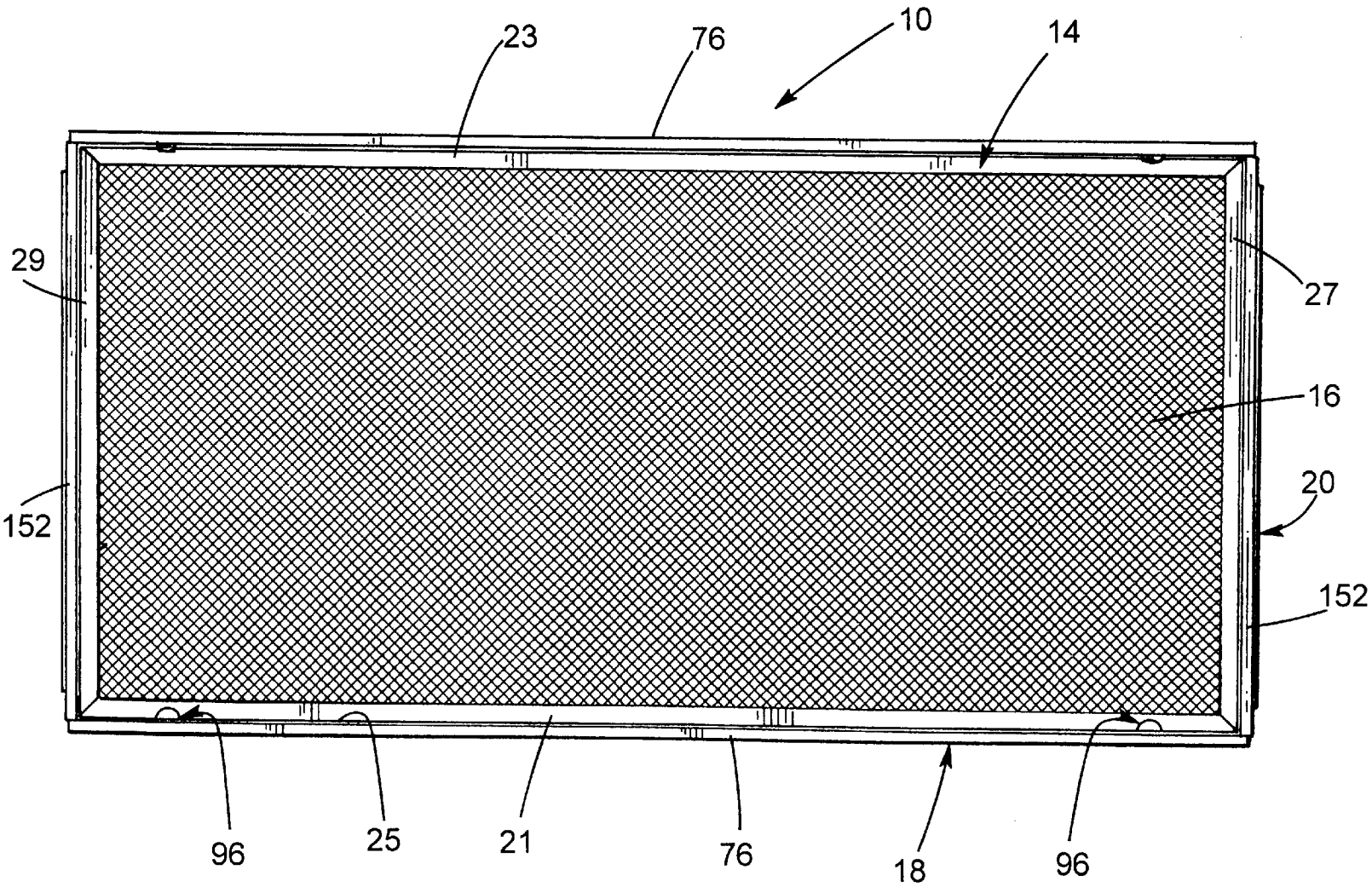
FIG. 6 is a bottom view of the lighting fixture of FIGS. 1 through 5.

FIGS. 5 and 6 illustrate an assembly of the door frame 14 to the housing assembly 12 from a position beneath the fixture, the prismatic lens cover 16 being visible and shown to be carried by the door frame 14. The door frame 14 is seen to fit flushly within a peripheral recess 25 defined by structural portions of the housing channel 18 and of the end plates 20 as is described herein. The ledges 72 and 74 disposed along each side edge of the housing channel 18 and flanges 148 and 152 of each of the ends plates 20 as seen in copending Ser. No. 09/358,376, filed of even date, define the recess 25, the recess 25 being dimensioned to receive the door frame 14 flushly thereinto. Receipt of the door frame 14 into the recess 25 coupled with structure to be described hereinafter which is integral with the side structural bars 21, 23 and end structural bars 27, 29 and in combination with the light trap elements 174 effectively block light from leaking through the interface between the door frame 14 and the housing assembly 12 thus causing a light trap to be formed. The hinge elements 94 are located along the edge of the fixture 10 along which the side structural bar 23 is disposed. However, the hinge elements 94 are not visible in FIGS. 5 and 6. Structure specifically described in detail in copending patent application Ser. No. 09/358,376, filed of even date as aforesaid and as identified above is also to be seen in FIGS. 5 and 6 to form a border about visible peripheral portions of the door frame 14, this structure being identified in said copending patent application and herein as flanges 76 formed integrally with the housing channel 18 and flanges 152 formed integrally one each with each one of the end plates 20. Lowermost surfaces of the flanges 76, 152 can be seen from below the fixture 10 in an installed situation. The flanges 76 and 152 are disposed about the periphery of the recess 25 into which the door frame 14 is flushly received. As is seen in FIGS. 5 and 6, the door frame 14 and the lens cover 16 carried thereby form an aesthetically pleasing interface with the housing assembly 12 by virtue of flushly fitting within the recess 25 as aforesaid and having borders defined by the flanges 76, 152 respectively formed integrally with the housing channel 18 and the end plates 20.

Figure 7:
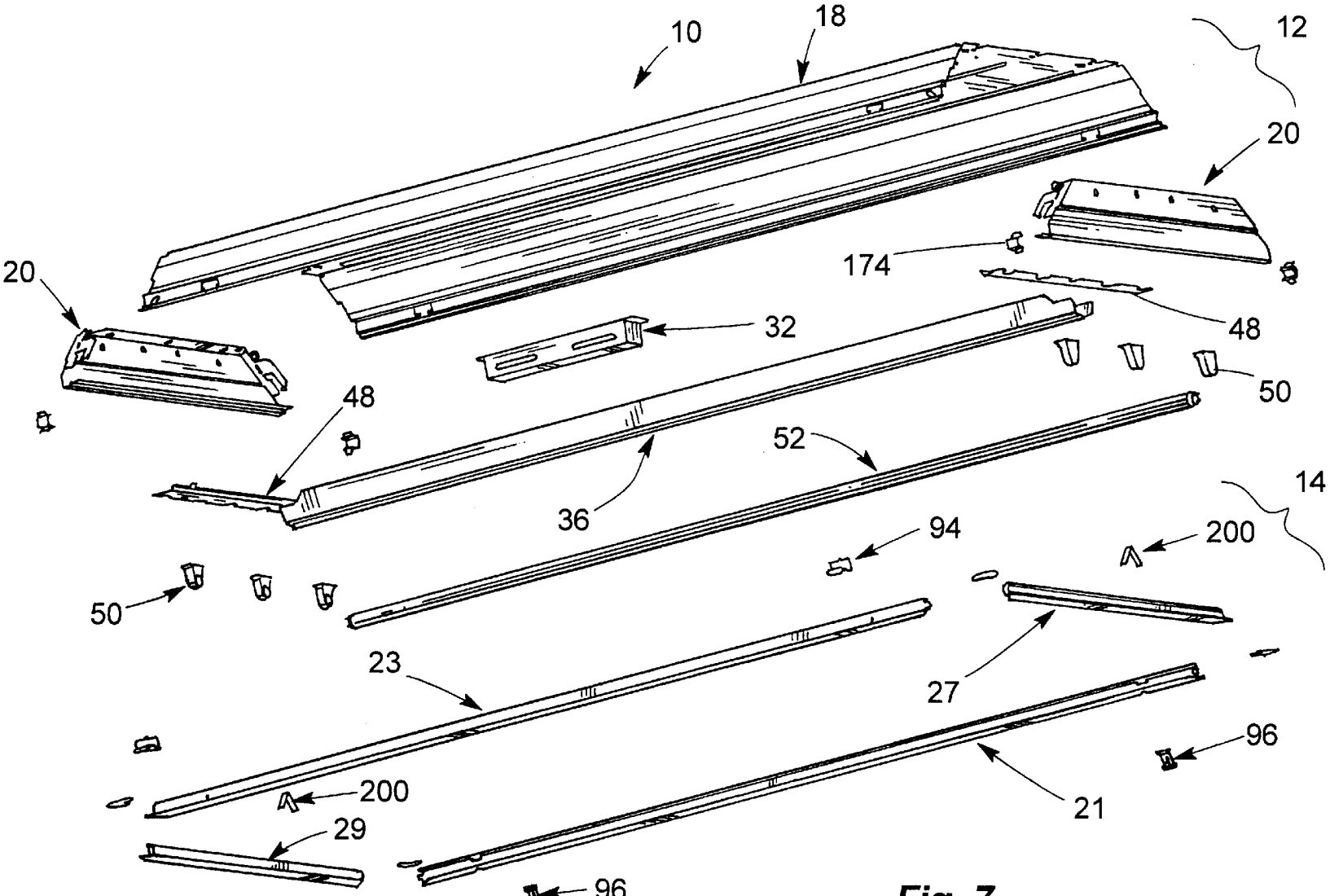
FIG. 7 is an exploded assembly view of the lighting fixture of FIGS. 1 through 6 with a lens cover being removed for ease of illustration.
Figure 8:
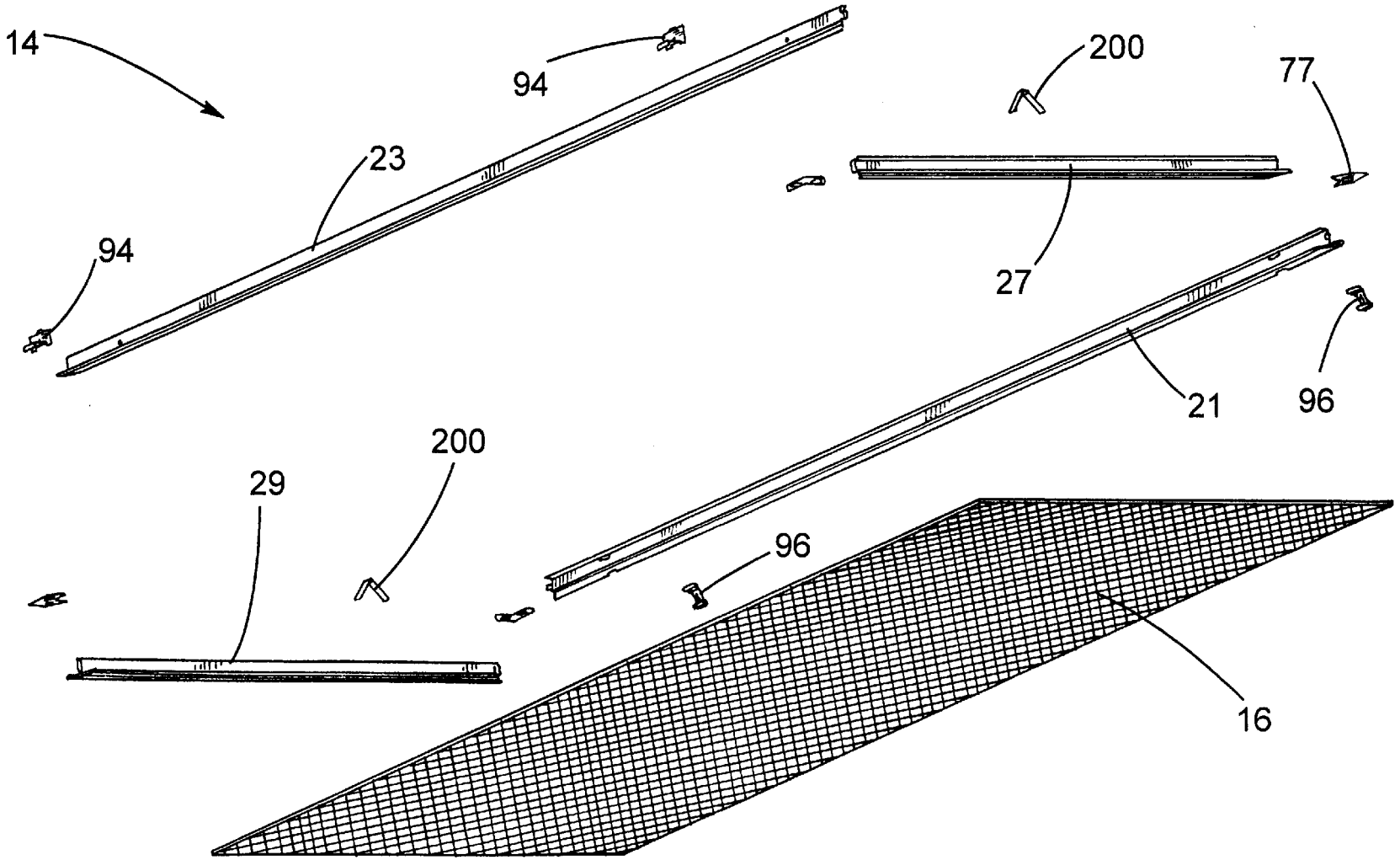
FIG. 8 is an exploded assembly view of the door frame and light trap assembly configured according to the invention and being shown in spaced relation to a lens cover.

FIGS. 7 and 8 provide exploded assembly views, the illustration of FIG. 7 providing an assembly view of the entire lighting fixture 10 with the exception of the lens cover 16. FIG. 8 provides an exploded assembly view of the door frame 14 with the inclusion of the lens cover 16. Various structural elements of the fixture 10 and particularly of the housing assembly 12 are seen with reference to numerals which are employed in copending patent application Ser. No. 09/358,376, filed of even date and referred to hereinabove. This numbering of structural elements not necessarily described explicitly in this patent application is intended for ease of reconciling the disclosure of this patent application in view of the disclosure of the aforesaid copending patent application, thereby to facilitate understanding of both applications. As seen in FIGS. 7 and 8, the side structural bars 21, 23 connect to the end structural bars 27, 29 to form a frame within which the lens cover 16 is securely carried, the details of the assembly of the bars to each other being provided hereinafter.

Figure 9:
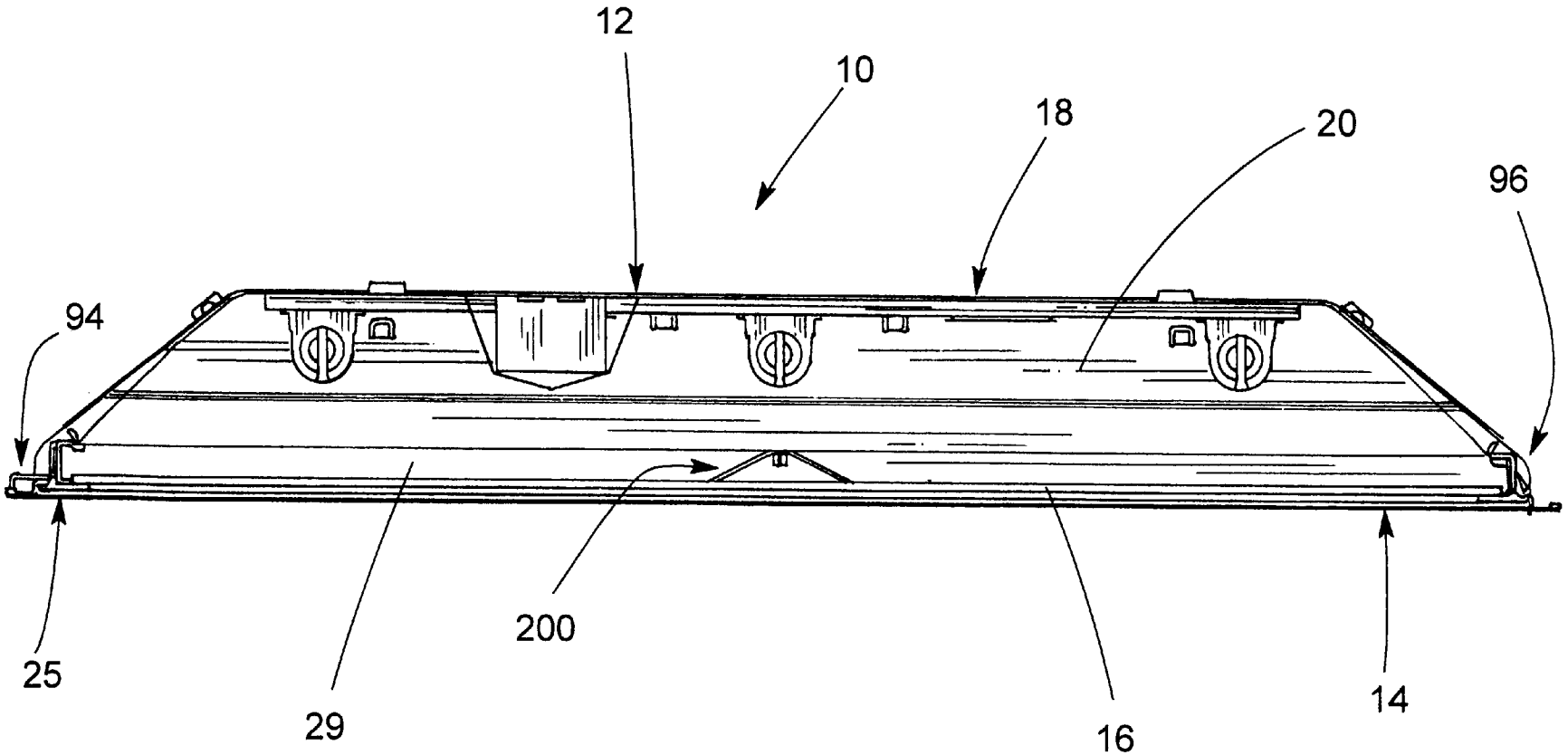
FIG. 9 is an elevational view of the lighting fixture of FIG. 1 with an end plate removed in order to view internal portions of the fixture.
Figures 10A, 10B, 10C, 10D, 10E, 10F:
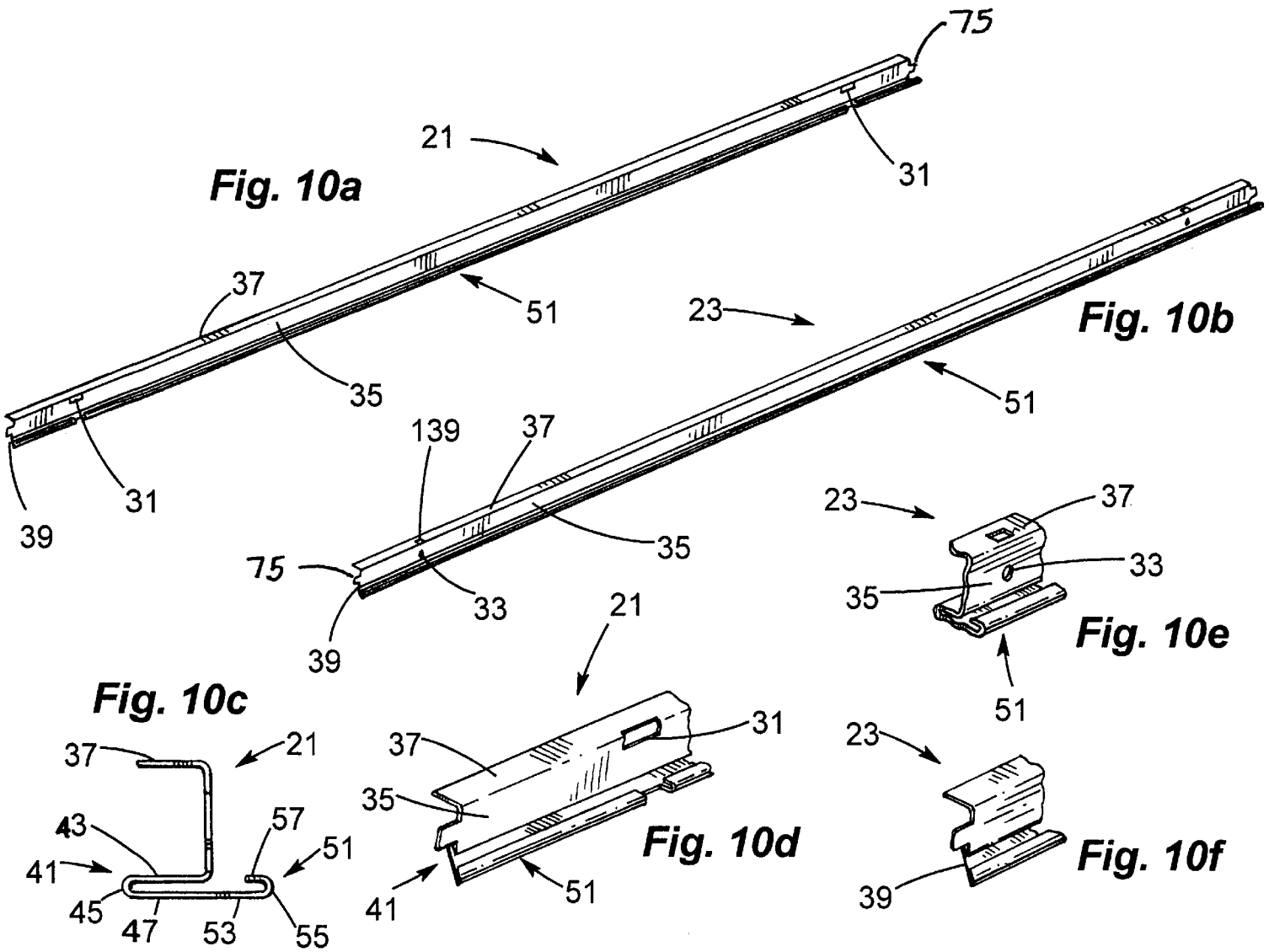
FIGS. 10A through 10F are perspective, end elevational and detail perspective views of side structural bars configured according to the invention.
Figure 11C:
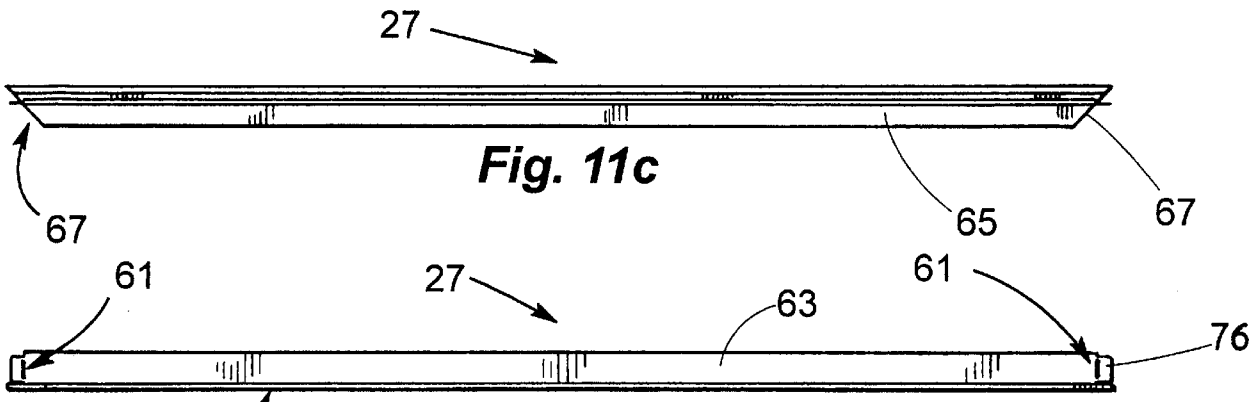
FIGS. 11A through 11D are perspective, side elevational and end elevational views of end structural bars configured according to the invention.
Figure 11B:
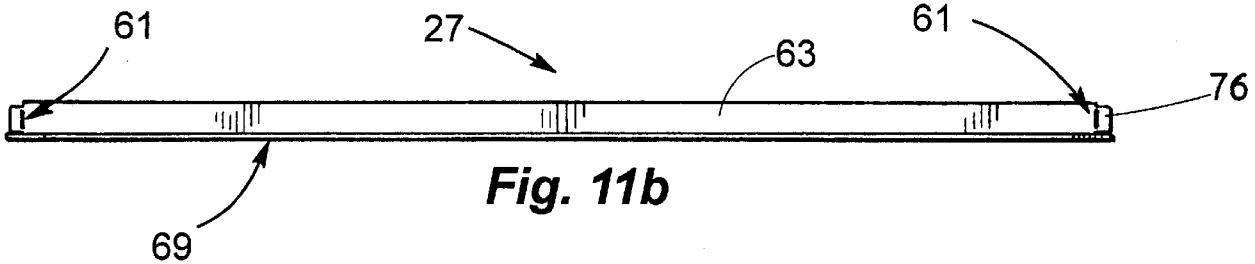
Figure 11A:
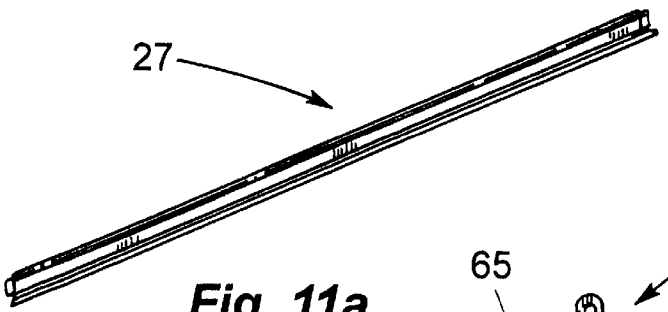

Referring now to FIG. 9, the fixture 10 is seen from an end elevational view with one of the end plates 20 being removed so that it is possible to see interior structure of the housing assembly 12, such as the sockets 50 which mount lamps such as the lamp 52 which is seen in FIG. 7. For ease of illustration, the lamping is typically not shown in the various figures so that the structure of the fixture 10 can be better understood. It is to be understood as is described in the copending patent application referred to hereinabove that the fixture 10 is intended to utilize T8 fluorescent lamps of the elongated tubular type, these lamps such as the lamp 52 being mounted conventionally by the sockets 50.

Referring now to FIGS. 10A through 10F, the structures of the side structural bars 21 and 23 are shown, the structures of said bars 21, 23 being essentially identical except for the provision of certain openings formed therein. In the side structural bar 21, a rectangular opening 31 is formed near each end of the bar 21 for receiving one each of the latching elements 96 as will be described hereinafter. In the side structural bar 23, a single circular aperture 33 is formed one each near each end of the bar 23 in order to mount one each of the hinge elements 94. Openings 139 are formed one each above the apertures 33 in flanges 37 of the bars 23. The remaining structure of the bars 21, 23 is identical and description of one will suffice for a description of the other. Considering the side structural bar 21 with particular reference to FIG. 10C, an elongated central body 35 is substantially planar in conformation and is the portion of the bar 21 having at least a portion of the rectangular openings 31 formed therein. In a similar manner, the elongated central body 35 of the bar 23 has the circular apertures 33 formed therein. The flanges 37 are elongately formed along one side edge of the central body 35 of each of the bars 21, 33, the flanges 37 being substantially planar and being bent at right angles to said bodies 35. The rectangular openings 31 extend into that bend in the bar 21 between the body 35 and the flange 37. The flange 37 extends essentially the full length of the edge of the body 35 of the bars 21, 33 and terminates at ends 39 thereof Along the opposite side edge of the central body 35 of each of the bars 21, 23, a U-shaped flange 41 is formed with a first leg 43 taking the form of an elongated, planar piece of material lying in a plane which is substantially parallel to the plane of the flange 37. Yoke 45 of the U-shaped flange 41 recurves to join with second leg 47 of said flange 41, the second leg 47 extending outwardly of the plane within which the central body 35 lies and recurving outwardly thereof to form a U-shaped outer flange 51. The U-shaped outer flange 51 has a first leg 53 which is an extension of the second leg 47 of the U-shaped flange 41, yoke 55 of the U-shaped outer flange 51 recurving inwardly to form a second leg 57 which, like the other legs 43, 47 and 53, comprise elongated planar structural elements. It is to be understood that the side structural bars 21 and 23 can be formed from a single piece of material by conventional operations. It is further to be understood that wall surfaces of the leg 43 and the leg 47 interiorly of the U-shaped flange 41 are spaced apart as are wall surfaces of the legs 53 and 57 of the U-shaped outer flange 51. Each end of the structural bars 21, 23 are essentially identical in structure to the other, the flanges 41 and 51 being cut off at each end of said bars at a mitered angle essentially identical to the angle of the mitered end 39 of the flange 37. Each end of the central body 35 of each of the bars 21, 23 terminates in a substantially rectangular tab 59. An elongated slot (not shown) formed substantially centrally of the juncture between the end of the body 35 and an inward side edge of the tab 59 can be formed in the bars 21, 23 to facilitate bending of the tab 59 relative to each of the bodies 35.

Referring now to FIGS. 1A through 1D, the end structural bar 27 is shown. Since the end structural bar 29 is identical to the structure of the end structural bar 27, only the bar 27 will be described herein. The bar 27 is formed of an elongated central body 63 which is planar in conformation and which bends along one side edge thereof at right angles to form an elongated flange 65 which extends essentially the full length of the side edge of the body 63, ends of the flange 65 being mitered at 67. At the other side edge of the body 63, a U-shaped flange 69 extends therefrom and terminates at the outward end of leg 71 of said flange 69 in a U-shaped outer flange 73, the cross-sectional shape of the end structural bars 27 and 29 being essentially identical to the cross-sectional shape of the side structural bars 21 and 23. The ends of the U-shaped flanges 69 and 73 are also mitered as is the flange 65 as aforesaid. A locking tab 75 extends from each end of the body 63 and slots 61 are formed substantially centrally of the juncture between the end of the body 63 and the inward side edge of the tab 75. The slots 61 facilitate bending of the tabs 75 and receive the tabs 59 for connection of the bars 27, 29 to the bars 21, 23.

Figure 12:
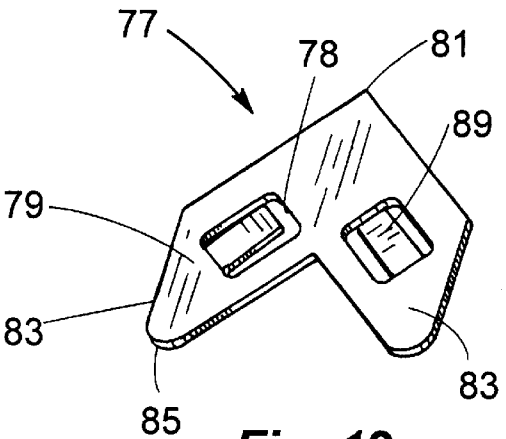
FIG. 12 is a perspective view of a corner connection element or "biscuit" configured according to the invention.
Figure 11D:
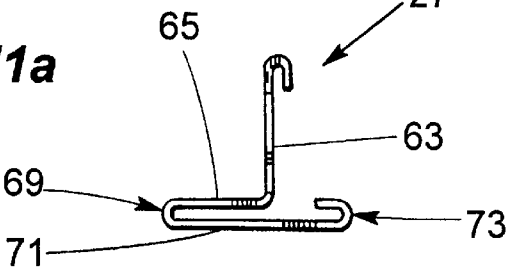

As is seen in FIG. 12, a corner reinforcement plate 77 is seen to comprise a planar body portion 79 of chevron shape, the plate 77 having a substantially 90° point at 81 with lateral legs 83 formed on each side of the plate 77. The legs 83 are rounded at 85. Punched-out apertures 78 formed in each leg 83 each retain pressure plates 89 bent within said apertures 78. Free ends of the plates 89 extend outwardly of the apertures 78. The plate 77 functions substantially in the manner of a "biscuit" such as is employed in woodworking. Essentially, the plate 77 acts to reinforce corner joints between the respective side structural bars 21, 23 and the end structural bars 27, 29.

Figure 13:
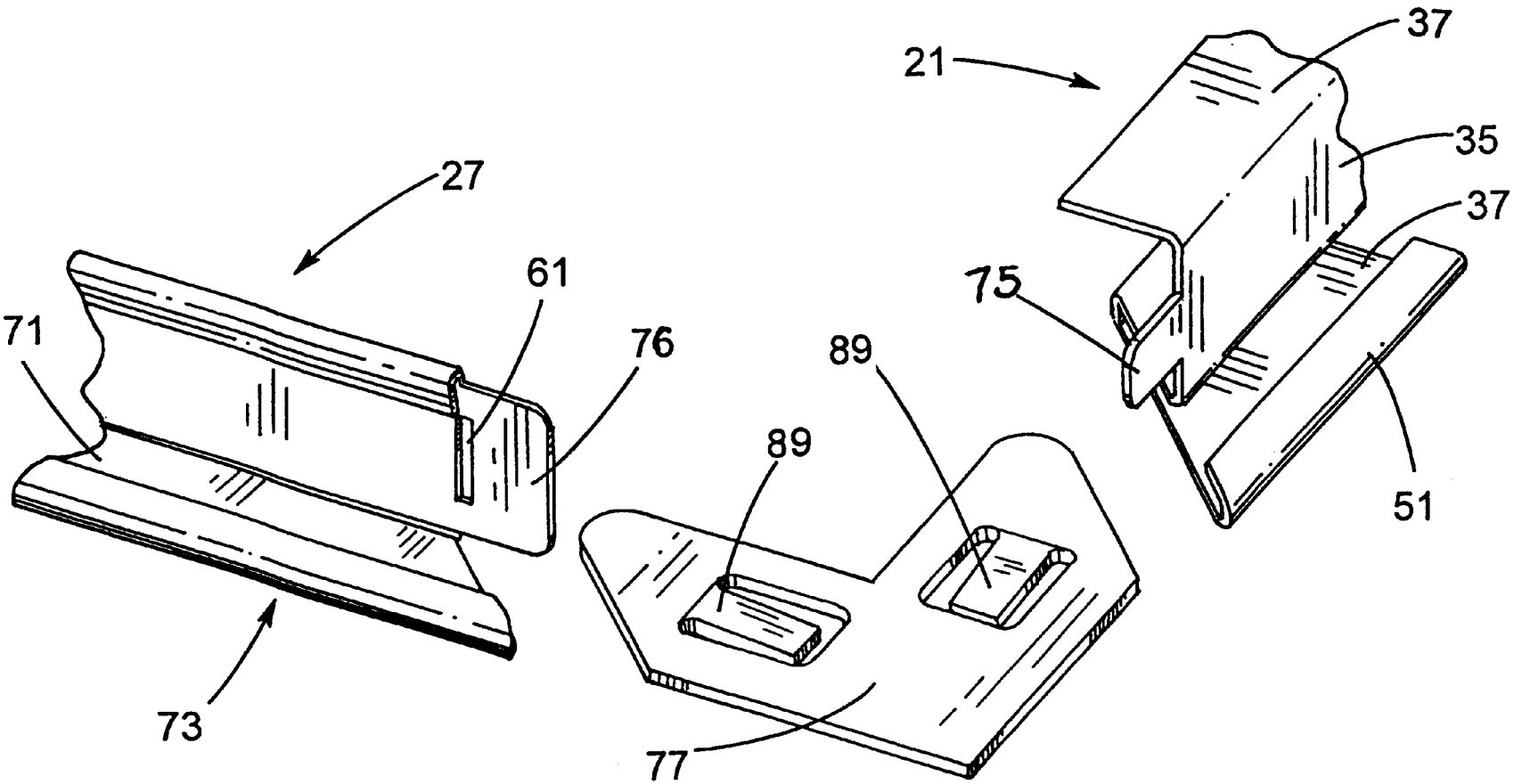
FIGS. 13, 14 and 15 are perspective views illustrating assembly of the structural bars of the invention together in combination with the biscuit of FIG. 12.
Figure 14:
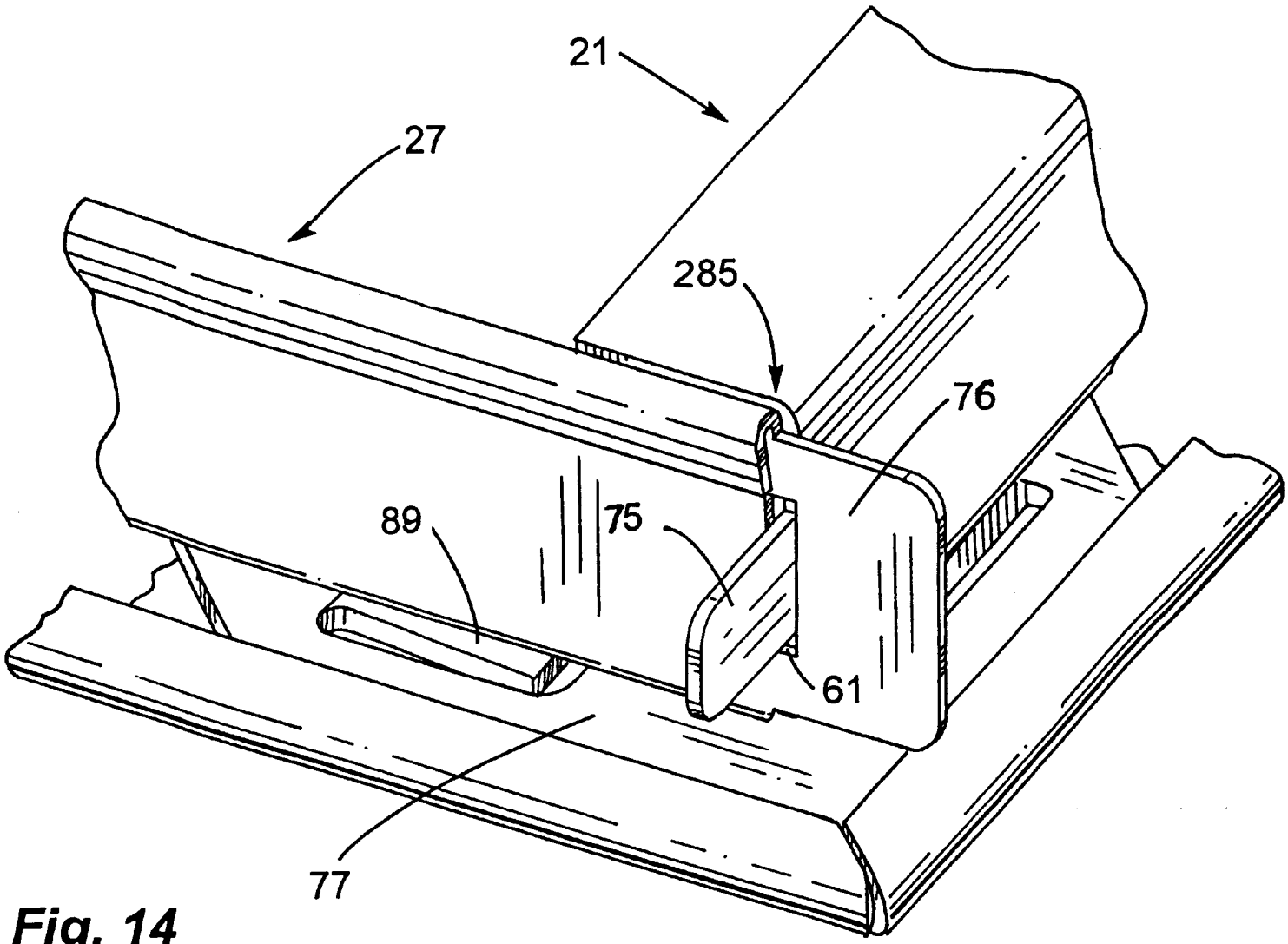
Figure 15:
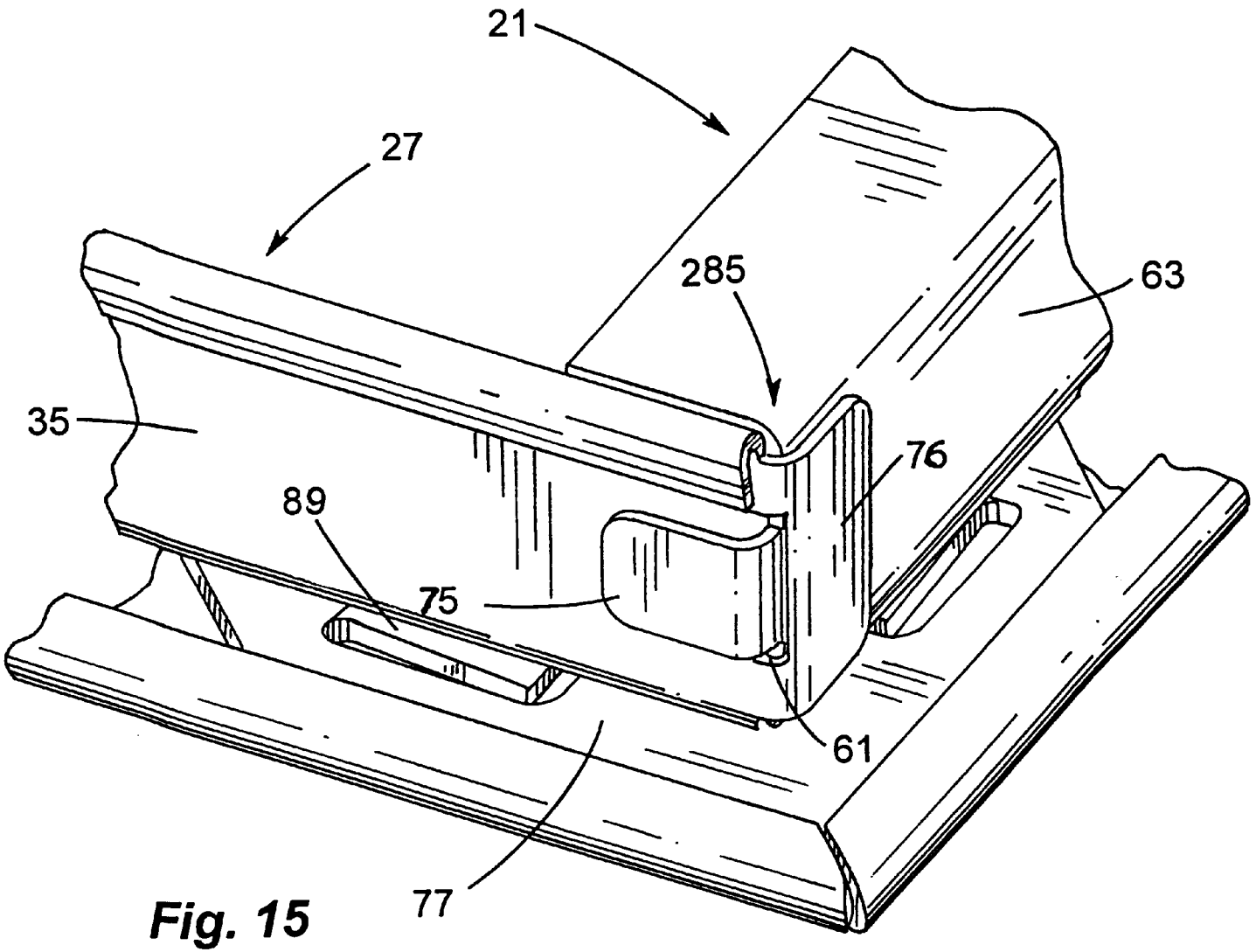
Figure 16A:
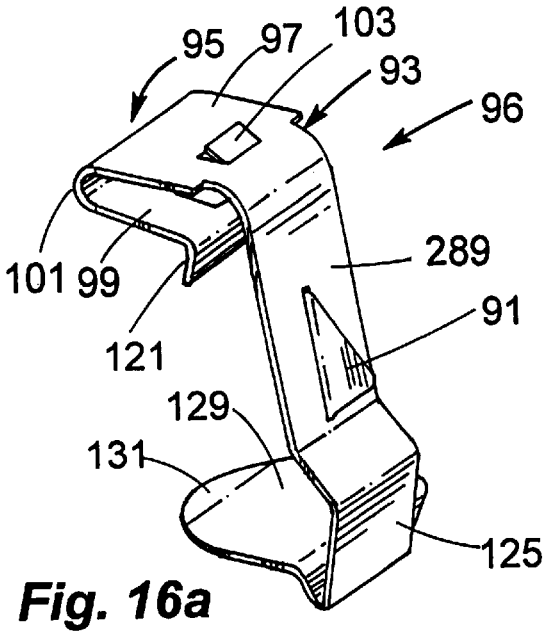
FIGS. 16A through 16E are related perspective and detail views of a latching element which allows rapid latching and unlatching of the door frame and light trap assembly to remaining portions of a lensed troffer lighting fixture.
Figure 16B:
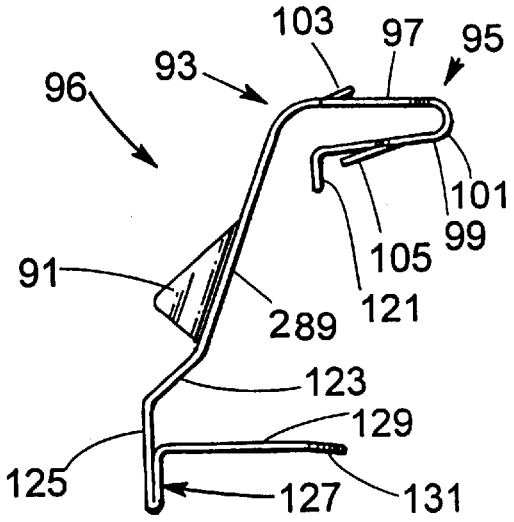
Figure 16C:
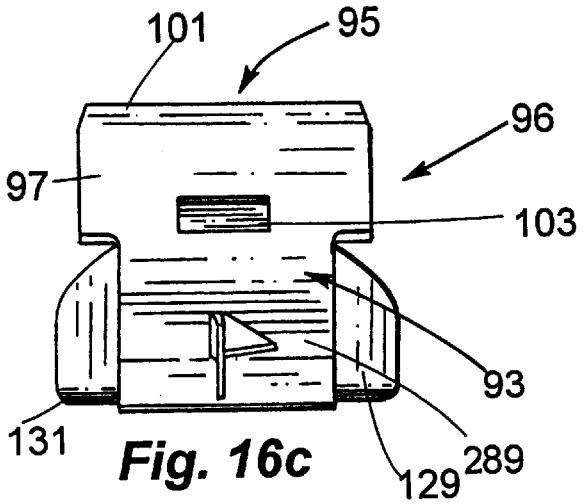
Figure 16D:
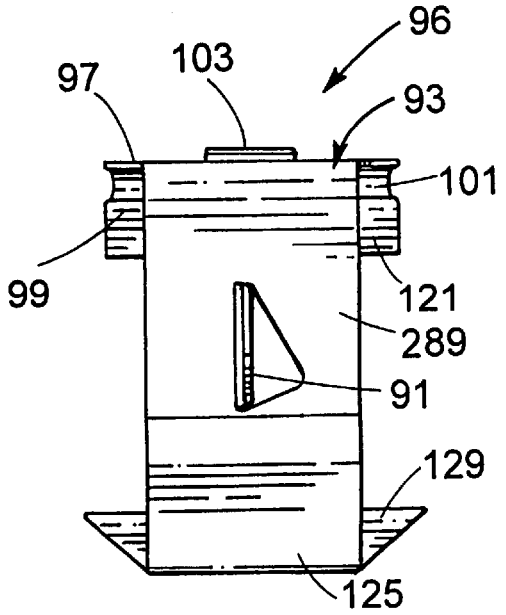
Figure 16E:
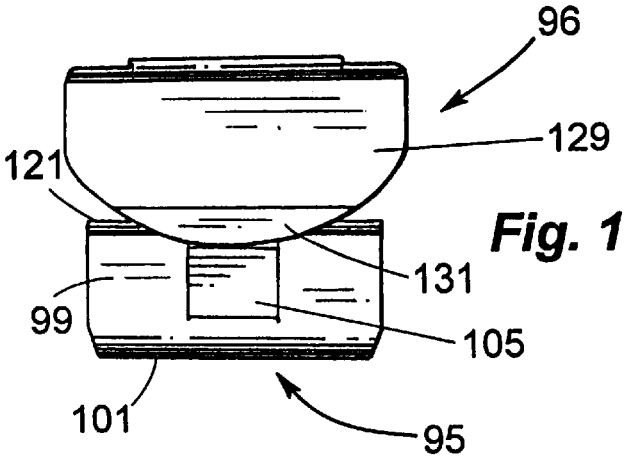

As is seen in FIGS. 13 through 15, assembly of the bars 21, 23 and 27, 29 together is shown in sequential steps to form the door frame 14 with a corner joint being shown at the corner seen in the figures. Each corner of the door frame 14 is so formed. In assembly, one of the lateral legs 83 of the corner reinforcement plate 77 is inserted into that space defined by inner wall surfaces of the flanges 41, 51 of the bar 21 or of the flanges 69, 73 of the bar 27 according to choice, the locking tab 75 of the side structural bar 21 (or 23) then being inserted into the slot 61 of the end structural bar 27 (or 29) with the other leg 83 of the corner reinforcement plate 77 then being received into the other of the yokes of said bars 21, 23 or of the bars 27, 29. This assembly is seen in FIG. 14 to illustrate assembly of the plate 77 to the bars 21, 23 and the bars 27, 29, thereby to form a strong corner joint 285. Mitered portions of the bars 21, 23 and mitered ends 39 of the bars 27, 29 fit together as seen in the drawings. Assembly is completed by the bending of the locking tab 75 at right angles against an outer surface of the central body 35 of one of said bars 27, 29 and the bending of the tab 76 against outer surfaces of the central body 63 of each the bars 21, 23. Each of the corner joints 285 are thus completed to substantially complete the door frame 14 with the exception of the assembly of the hinge elements 94 and the latching elements 96 thereto.

Referring now to FIGS. 16A through 16E, one of the latching elements 96 is shown in detail. Since the latching elements 96 are substantially identical to each other, a description of one of the latching elements 96 will suffice for a description of both. The latching element 96 is formed of a body member 289 which takes the form of a planar, rectangular plate from which lance 91 is stamped, the lance 91 extending from an outward face of the latching element 96. The lance 91 is substantially triangular in conformation and provides a ramping function relative to portions of the channel 18 on assembly of the door frame 14 to said channel 18, the lance 91 resting against opposing portions of the channel 18 on assembly of said door frame 14 thereto. The body member 89 bends at 93 to form an arcuate section which terminates in a U-shaped element 95 comprised of respective legs 97 and 99 which are spaced apart and angled relative to each other and which are further joined together by means of yoke 101. As will be seen from description given hereinafter, the U-shaped element 95 is inserted into an appropriate opening in a portion of the door frame 14 with the yoke 101 being first inserted, the ability of the legs 97, 99 to be compressed and then spring apart facilitating attachment of the latching element 96 to the door frame 14. The leg 99 terminates in a lip 121. A lance 103 punched out of the leg 97 has a free end which "faces" toward the door frame 14 during assembly, a lance 105 formed in the leg 99 facing the opposite direction from the lance 103. In essence, the lance 103 prevents the latching element from rotating in place. When properly connected to the door frame 14, the lance 103 does not actually abut structure on the door frame 14. The lance 105, sloping "backwardly" from the door frame 14 when assembled as will be described hereinafter, acts to prevent the U-shaped element 95 from being pulled from its connection with the door frame 14 as will be described hereinafter.

At the opposite end of the body member 89, the latching element 96 angles outwardly to form an extension element 123 which is dimensioned and formed simply to extend the lower portion of the latching element 96 from portions of the door frame 14 to allow clearance. The extension element 123 terminates in a plate 125 which extends at an angle from said plate 125 and substantially vertically when in use, the plate 127 doubling back upon itself at 127 and then angling inwardly to form actuation plate 129 which terminates with a lip 131. As will be described hereinafter, the actuation plate 129 is visible to a user of the fixture 10 in a use environment whereby the actuation plate 129 can be engaged manually such as by a finger to exert pressure on the latching element 96 in order to unlatch said element 96 from engagement with the housing assembly 12 of the fixture 10, thereby to open the door frame 14 so that the frame 14 can pivot about the hinge elements 94 located on the side structural bar 23 of the door frame 14 to allow access to the interior of the fixture 10. It is to be understood that the latching element 96 is preferably formed of a metal such as stainless steel configured with an appropriate thickness to produce a spring-like function. In essence, the body member 89 and the arcuate portion of the latching element 96 connecting the body member 89 with the U-shaped element 95 as is shown at 93 functions to act in a spring-like manner, this spring-like portion of the latching element 96, that is, the body member 89 essentially, extending through one of the slots 88 formed in the housing channel 18 as aforesaid. Accordingly, the latching element 96 can be manipulated in order to disconnect an upper surface of the actuation plate 129 from a notch formed in the U-shaped outer flange 51 of the side structural bar 21, thereby to disengage the door frame 14 along one side of the fixture 10.

Figure 17A:
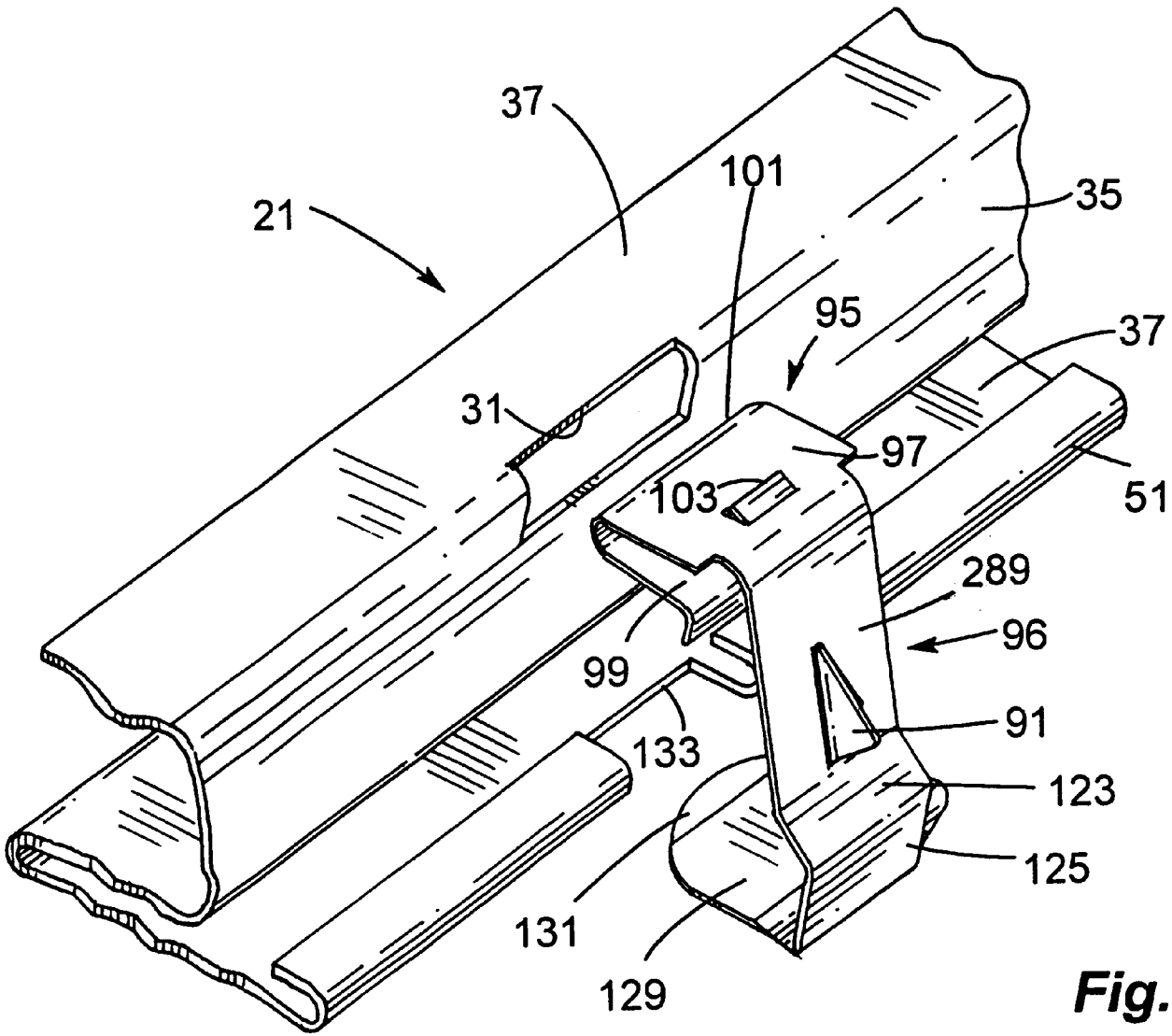
FIGS. 17A through 17E are perspective views illustrating assembly of the latching element to one of the side structural bars.
Figure 17B:
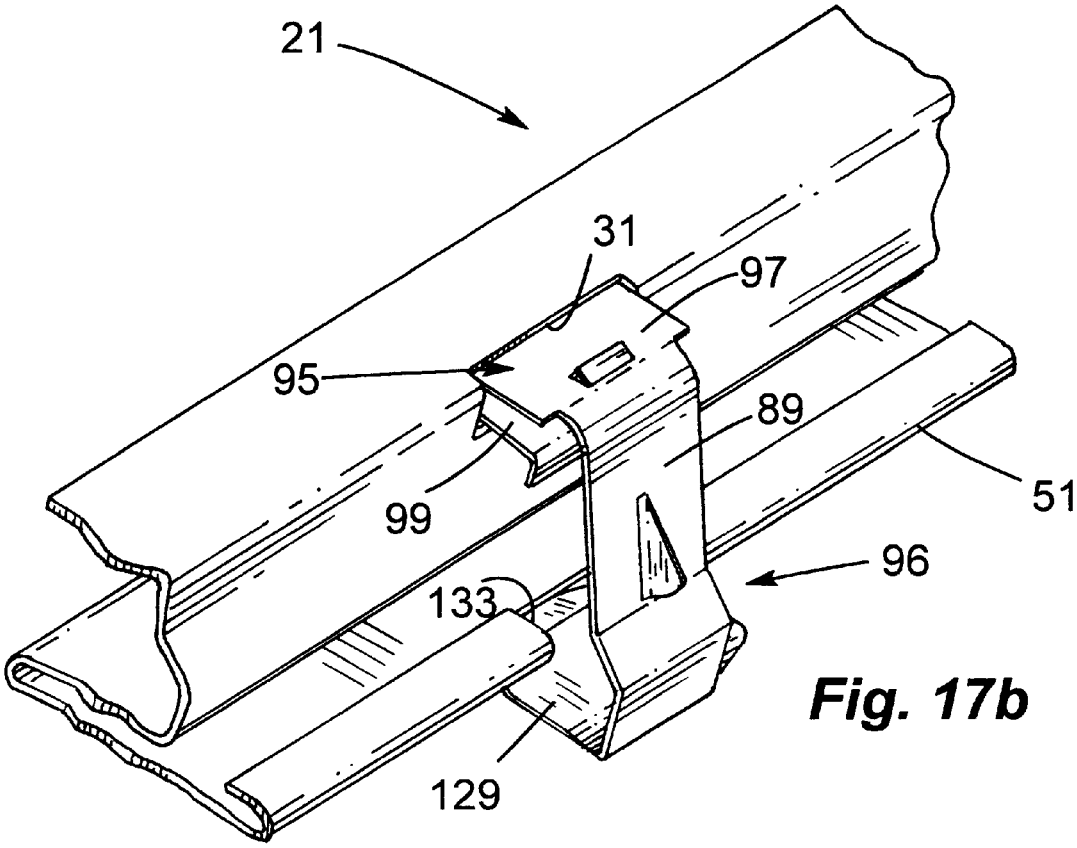
Figure 17C:
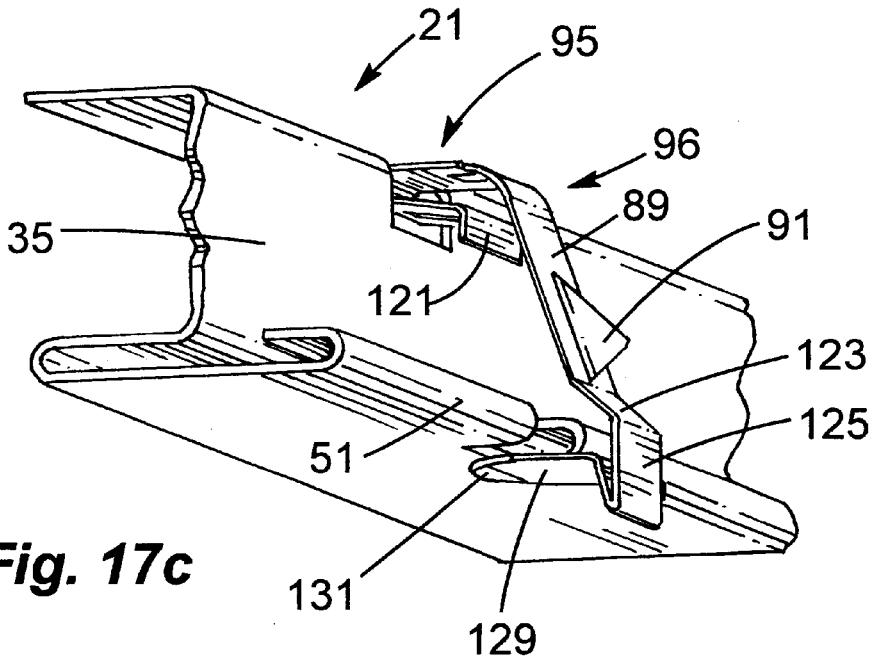
Figure 17D:
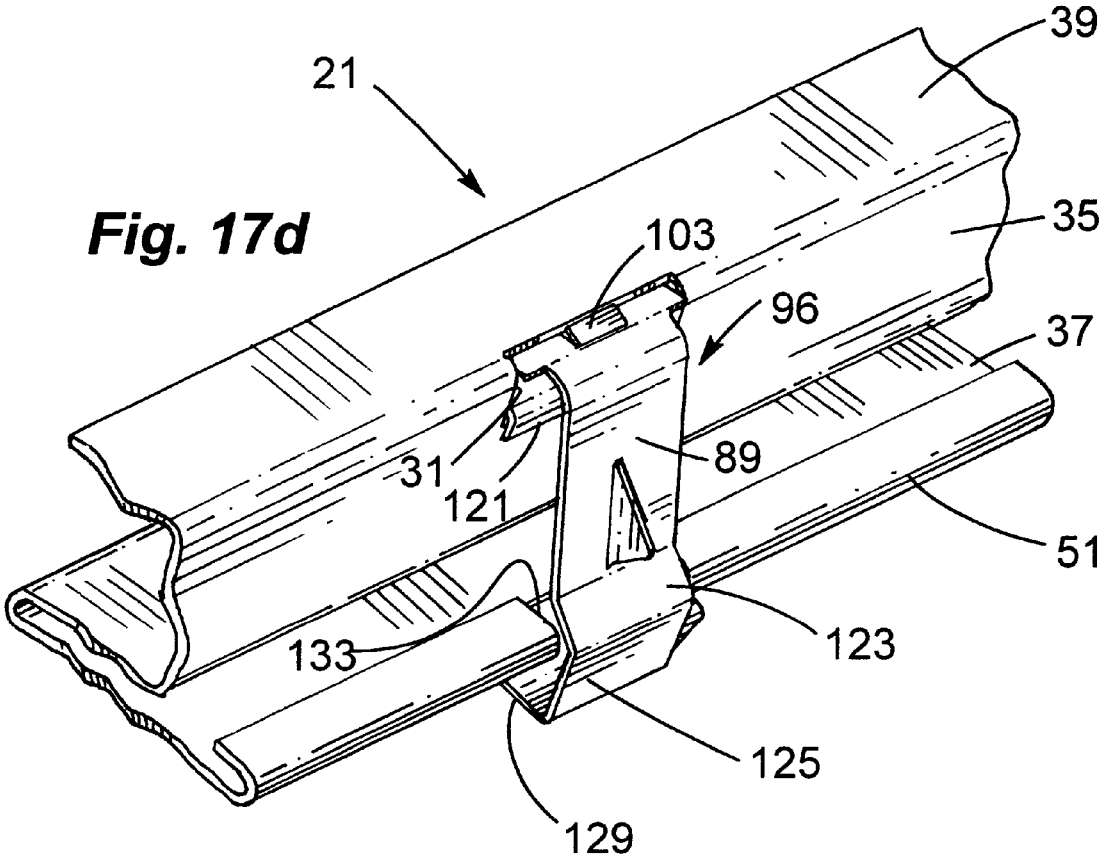
Figure 17E:
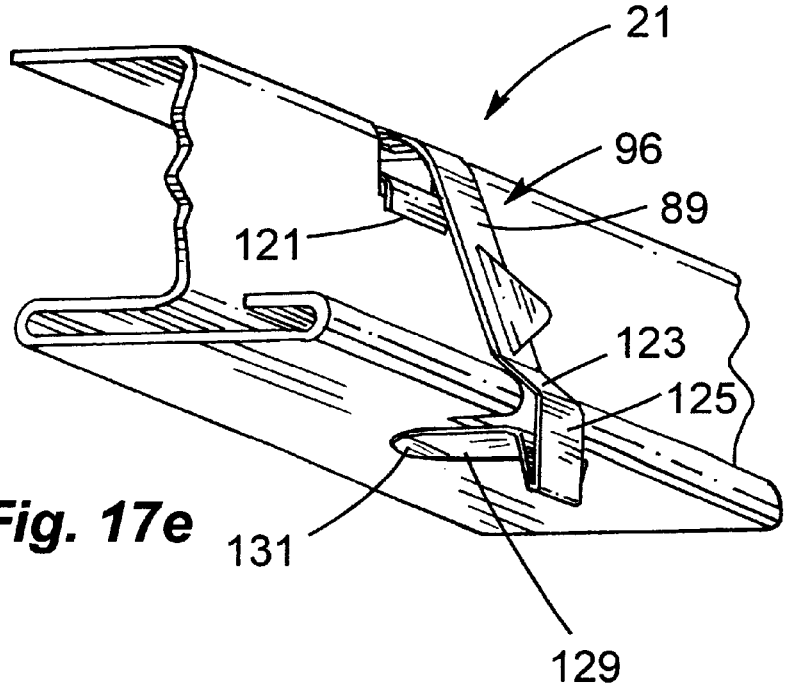

As is seen in FIGS. 17A through 17E, the U-shaped element 95 is received into the opening 31 formed in the bar 21 at each end of said bar 21, the U-shaped element 95 being compressed to allow receipt of substantially all of the U-shaped element 95 into said opening 31. As is best seen in Figure lD, the lance 103 formed in the leg 97 of the U-shaped element 95 remains outwardly of the opening 31 due to extension of the opening throughout that curved portion of the bar 21 connecting angled body portions of said bar 21. As indicated previously, the free end of the lance 103 does not abut edge portions of the opening 31 under normal circumstances but does function to prevent rotation of the latching element 96. As the U-shaped element 95 is inserted into the opening 31 as indicated above, the actuation plate 129 fits beneath the flange 51 of the bar 21 while portions of the element 123 and the plate 125 are positioned immediately outwardly of notch 133 formed in the flange 51 of the bar 21. The terminal lip 131 functions as a guide to prevent binding of any portion of the actuation plate 129 against edges of the notch 133. On full assembly of the latching element 96 with the bar 21 as is seen in FIG. 17E, the lance 105 formed in the leg 99 functions to prevent the latching element 96 from being pulled outwardly from or disengaged from the opening 31. It is to be noted that the lance 105 cannot be seen in FIG. 17E. When fully assembled, it is to be seen that pressure exerted on the actuation plate 129 causes portions of the extension element 123 and of the plate 125 to move into the notch 133, thereby unlatching the door frame 14 from the housing assembly 12. It is noted that the lance 91 engages the channel 18.

Figure 18:
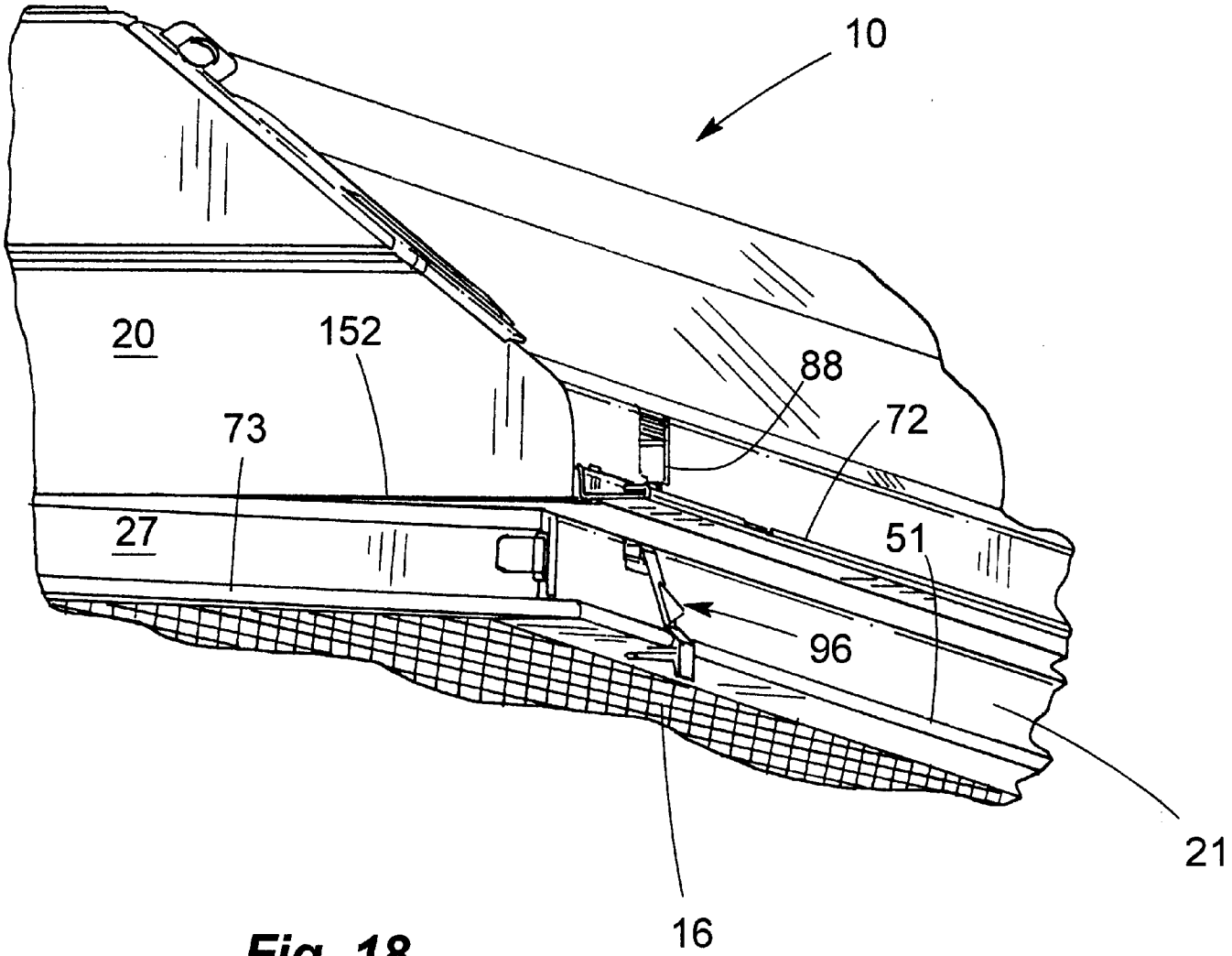
FIG. 18 is a detail perspective view of a corner of a lighting fixture configured according to the invention and illustrating operation of the latching element.
Figure 19:
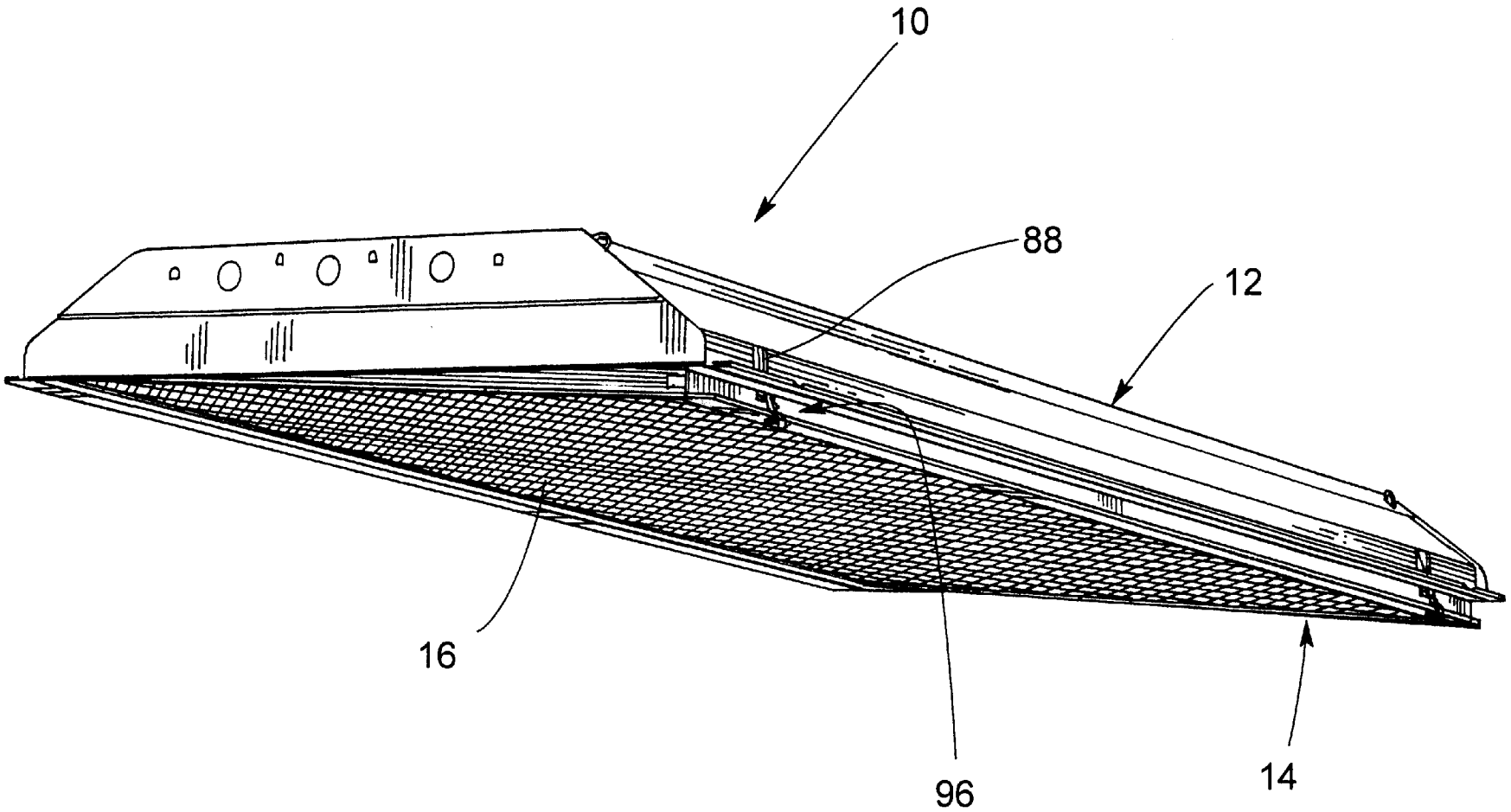
FIG. 19 is a perspective view of the lighting fixture of the invention showing the door frame and light trap assembly being fully unlatched from the remaining portions of the fixture.
Figure 21:
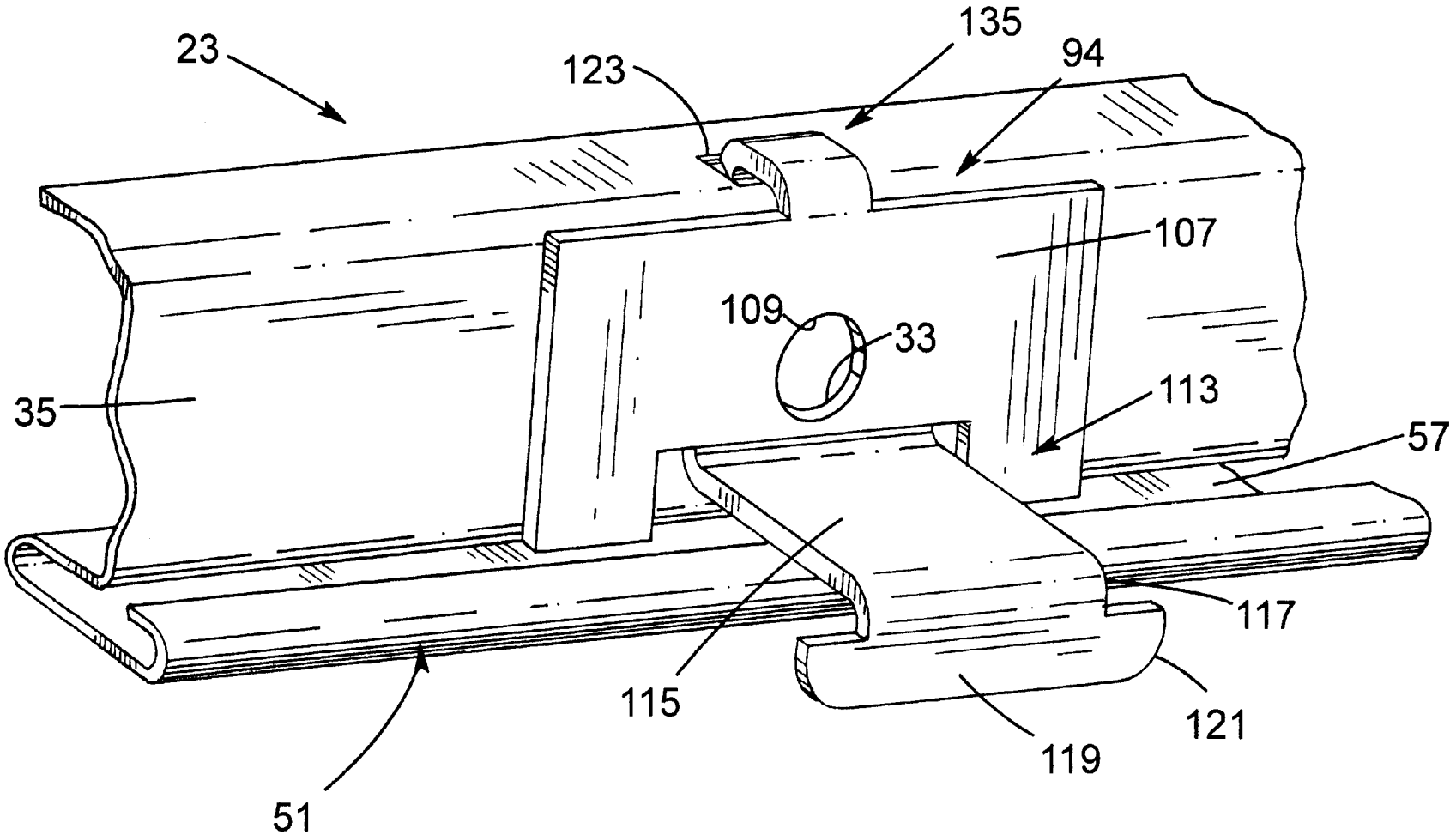
FIG. 21 is a detail perspective view of the hinge element mounted to one of the side structural bars.

FIGS. 18 and 19 illustrate disengagement of the latching element 96 from the slot 88 formed in the housing assembly 12. The latching elements 96 are seen to be completely disengaged from the housing assembly 12 so that the edge of the door frame 14 along which the bar 21 lies can be displaced downwardly to the position shown and can further be displaced through its full range of motion to the position shown in FIG. 22 wherein the hinge elements 94 retain the door frame 14 on the fixture 10 for access into the interior of the fixture 10 such as for relamping or other maintenance. Once maintenance is completed, the door frame and lens cover 16 retained by the door frame can then simply be pivoted back into position with the latching elements 96 releasably locking said door frame 14 to the housing assembly 12 by a simple fitting together of the component parts of said door frame 14 and of the housing assembly 12 as provided by the latching elements 96. FIGS. 18 and 19 show the first stages of the pivoting of the door frame 14 from engagement with the housing assembly 12, a full pivoting movement of the door frame 14 relative to the housing assembly 12 as contemplated by the invention resulting in the configuration seen in FIG. 22. In FIG. 21 inter alia, it can further be seen that the U-shaped outer flanges 51 and 73 formed as integral portions of the side bars 21, 23, and the end bars 27, 29 respectively extend over horizontal ledges 72 along each edge of the housing channel 18 and lateral flanges 152 of the end plates 20 respectively to form a light trapping function which function is substantially provided by integrally formed elements of the door frame 14 as aforesaid.

Figure 20A:
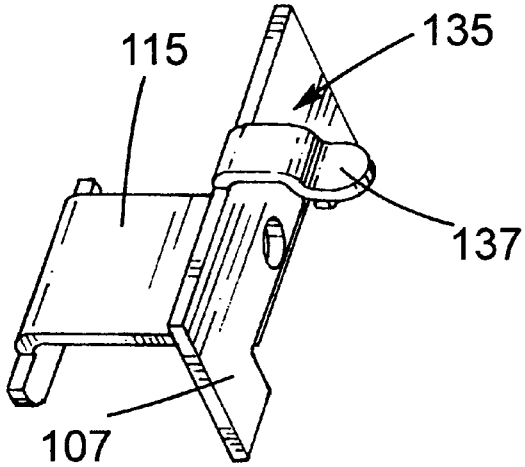
FIGS. 20A through 20C are perspective views of a hinge element configured according to the invention.
Figure 20B:
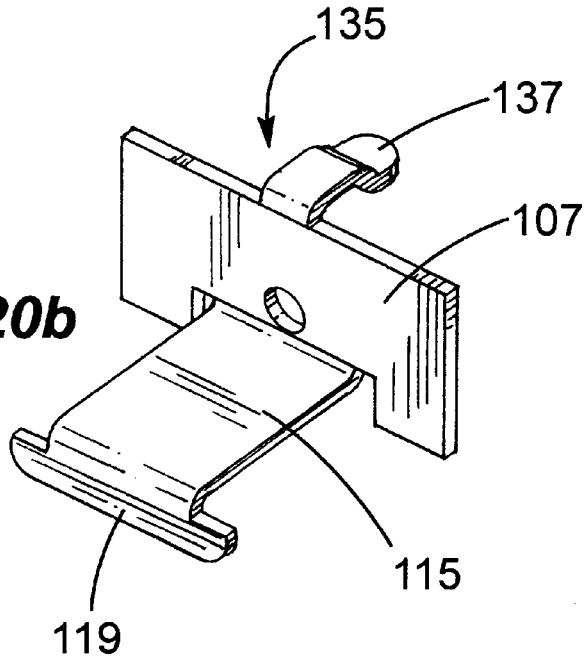
Figure 20C:
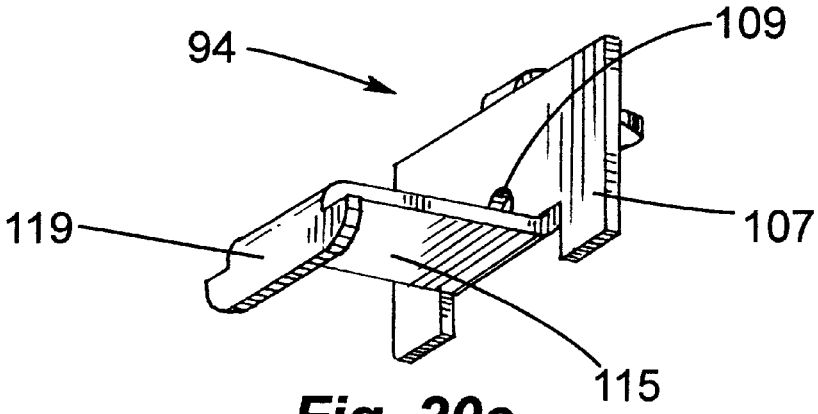
Figure 22:
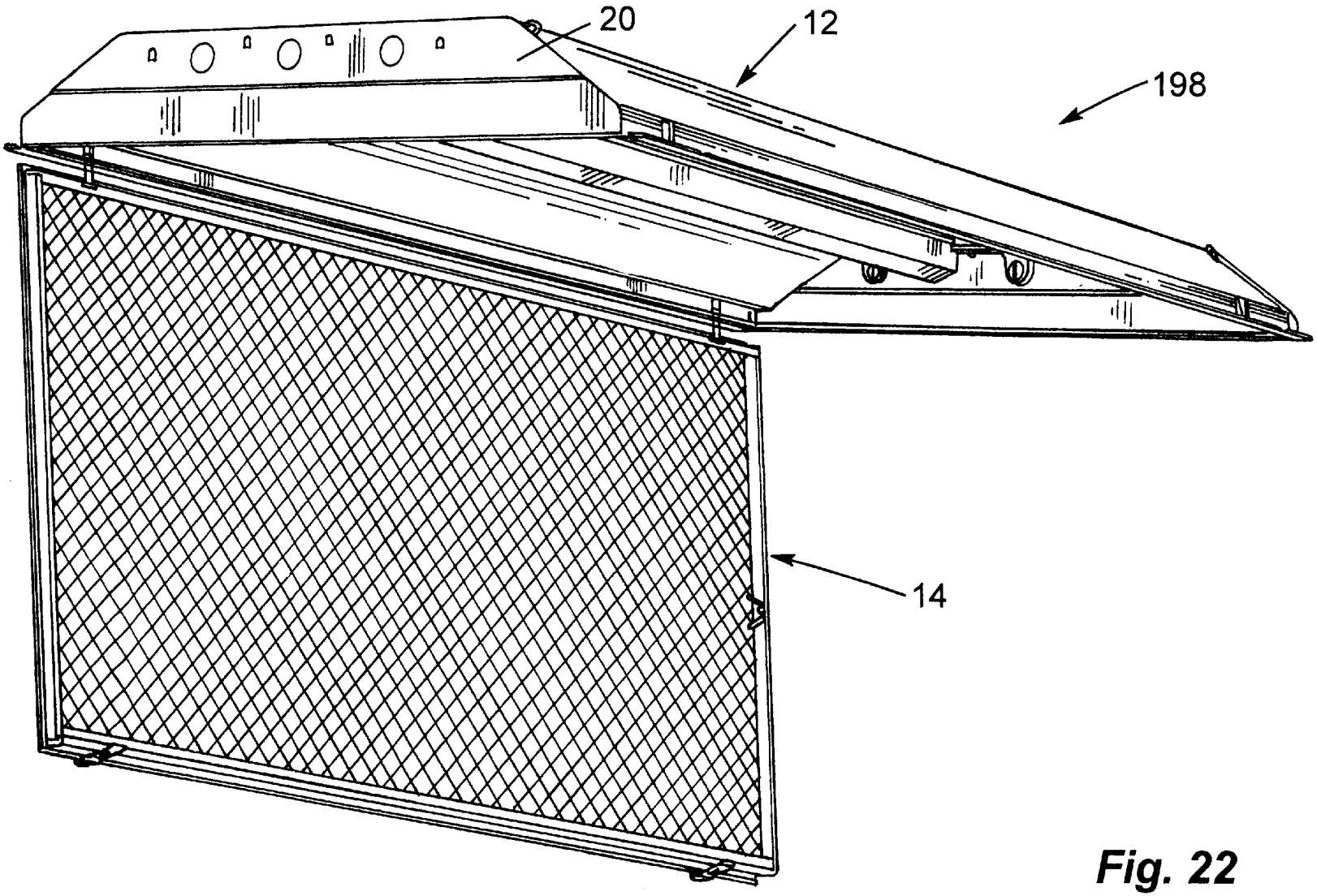
FIG. 22 is a perspective view illustrating the door frame and light trap assembly in a fully open position relative to remaining portions of a lighting fixture.
Figure 23A:
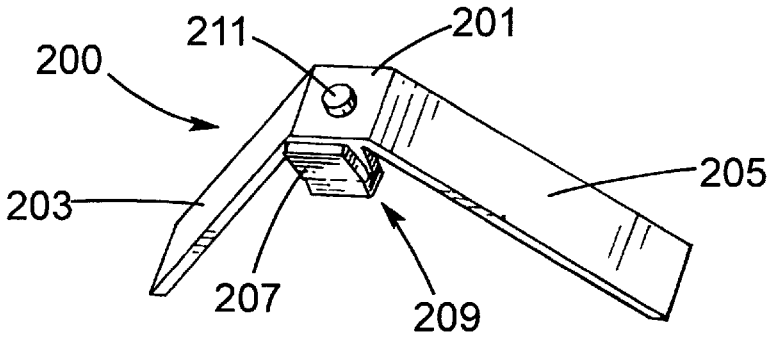
FIGS. 23A through 23D are related perspective and detail views of a lens cover retaining element; and, FIGS. 24A through 24E are related perspective and detail views of an alternative latch element.
Figure 23B:
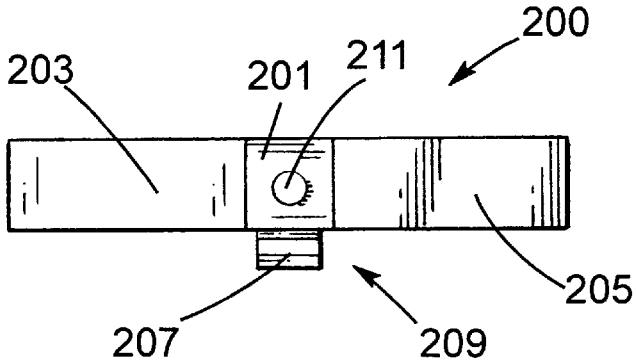
Figure 23D:
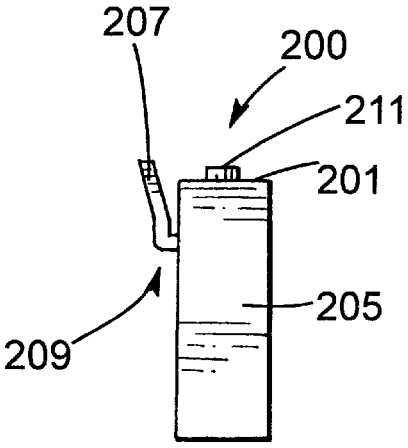
Figure 23C:
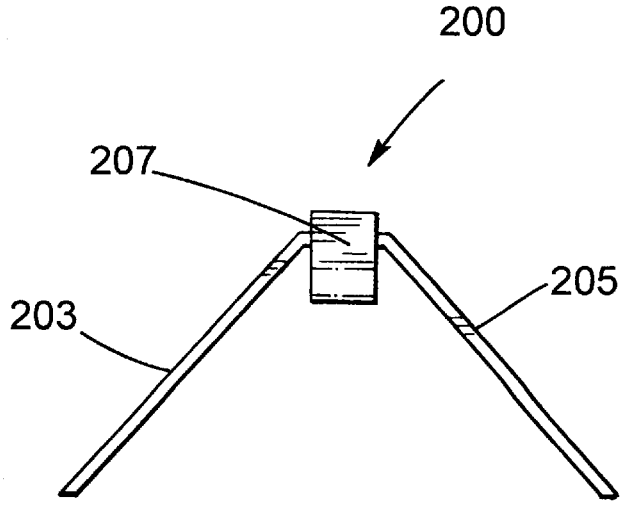
Figure 24A:
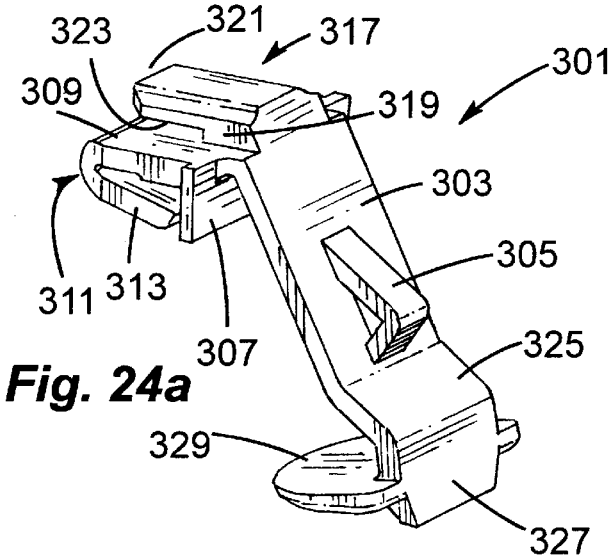
Figure 24B:
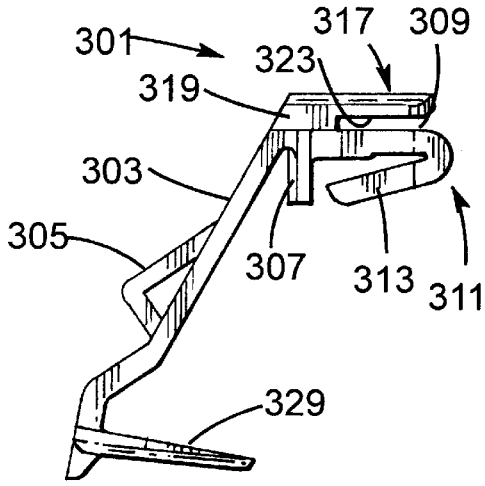
Figure 24C:
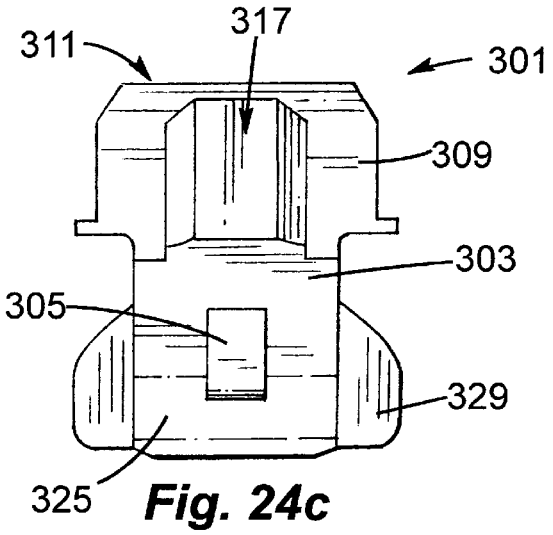
Figure 24D:
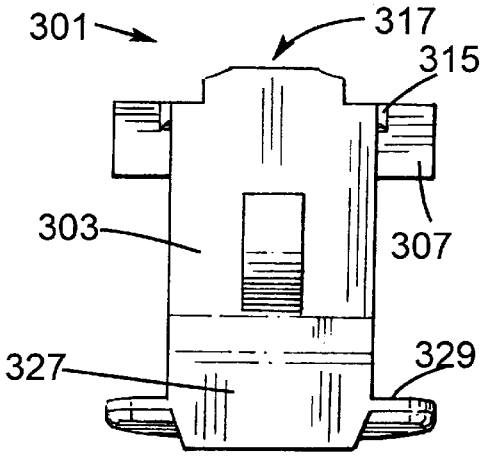
Figure 24E:
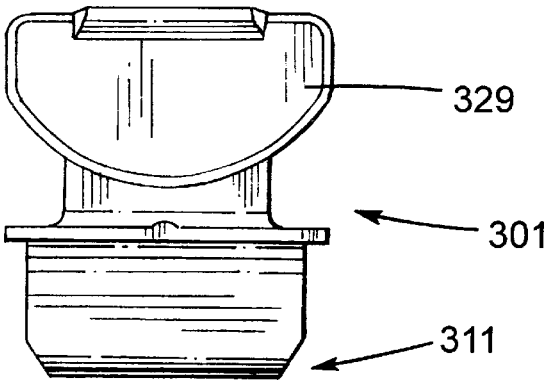

Referring now to FIGS. 20A through 20C, one of the hinge elements 94 is seen. Since the hinge elements 94 are substantially identical, a description of one of the elements will suffice for a description of both. The hinge element 94 is comprised of a base plate 107 which engages the central body 35 of the side structural bar 23, the base plate 107 having an aperture 109 formed therein for receiving a rivet (not shown) or the like therethrough, the aperture 109 aligning with one of the apertures 33 formed at each end of the side structural bar 23 so that the rivet is received through both the aperture 109 and the aperture 33 to hold the base plate 107 to the bar 23. The base plate 107 is further provided with depending legs 113 at either lateral end thereof, the legs 113 engaging inner wall surfaces of the flange 51 in order to provide increased stability. When only one rivet is utilized, the legs 113 act to prevent the base plate 107 from turning in place. A tongue element 115 extends from a lower edge of the base plate 107 outwardly of the bar 23, the tongue element 115 being slightly bent at its juncture with the base plate 107 and having an arcuate distal end 117 which curves away from the plane of the tongue element 115 in a direction away from the base plate 107 to terminate in an elongated tab 119 which is rounded at both ends 121. The length of the elongated tab 119 is dimensioned to fit within an enlarged rectangular portion 90 of the slot 88 so that the hinge element 94 can be connected to the housing assembly 12, the width of the tongue element 115 fitting within a lower rectangular portion 92 of lesser length formed in the housing assembly 12 such that the tongue element 115 can be movably received within the rectangular portion 92 of the slot 88 but wherein the elongated tab 119, having a length greater than the length of the rectangular portion 92 of the slot 88, cannot be displaced therefrom, thereby allowing the hinge elements 94 to effectively serve a hinging function and to maintain the door frame 14 in place as is seen in FIG. 22 when the door fame 14 is pivoted to a maximum degree relative to the housing assembly 12 to allow access into the interior of the lighting fixture 10. Centrally of the upper edge of the base plate 107 is formed a fastening element 135 having a U-shaped body portion terminating in a tab 137.

Now considering FIG. 21, the hinge element 94 is seen to be mounted to the central body 35 of the side structural bar 23 and thus to be configured for insertion of the elongated tab 119 into a portion of the slot 88 as aforesaid configured to receive said elongated tab 119, the hinge element 94 then being displaced within the slot 88 to cause the elongated tab 119 to be held by a portion of the slot 88 as aforesaid which is dimensioned to retain said tab 119 within the slot 88. The tab 137 is received within the opening 139 and is positioned to engage the underside of the body portion 39 of the bar 23, the U-shaped body portion of the fastening element 135 extending from the base plate 107 and through the opening 139 on assembly of the base plate 107 to the bar 23.

FIG. 22 provides illustration indicated previously relative to full opening of the door frame 14 relative to the housing assembly 12. FIG. 22 also illustrates a fixture 198 configured essentially identically to the fixture 10 previously illustrated with the exception that the housing assembly of the fixture 198 is of a reduced length. In particular, the fixture 198 of FIG. 22 illustrates a fixture which is substantially square in conformation with that side of the fixture 198 defined by the length of a housing channel being identical to the length of the end plate 20. Illustration of the fixture 198 is provided simply to show that the invention can be configured other than in the form of a single fixture having one particular set of dimensions.

Considering now FIGS. 23A through 23D in concert with other figures such as FIG. 9, a lens cover retainer 200 is seen to function in a manner which positively holds the lens cover 16 in place within the door frame 14. The retainer 200 comprises a base plate 201 having legs 203, 205 extending from opposite sides thereof, the legs being elongated and extending from the base plate 201 at angles. A locking tab 207 terminates a U-shaped element 209, a portion of the element 209 joining to the base plate 201. A disc-like projection 211 extends from an upper face of the base plate 201 to engage a circular opening (not shown) which is formed in a wall portion of the bars 27, 29 so that the retainer 200 can be conveniently held in place. The locking tab 207 in a similar sense can be received into a slot (not shown) formed in the bars 27, 29 or other portions of the door frame 14, receipt of the tab 207 into a slot such as described acting to lock the retainer 200 in place. It is to be understood that it is not necessary to provide both the locking tab 207 and the projection 211 simultaneously. The angled or "splayed" legs 203, 205 of the retainer 200 extend outwardly from the base plate 201 to engage the lens cover 16 when the retainer 200 is joined to the door frame 14 as aforesaid. Engagement of distal end portions of the legs 203, 205 with the lens cover 16 functions to hold the lens cover 16 in place. In the event that the plastic forming the lens cover 16 is wavy, it is sometimes necessary to provide conventional clips (not shown) along sides of the lens cover 16 in order to prevent bowing of the lens cover 16.

Referring now to FIGS. 24A through 24E, an alternative latching element 301 is seen, the latching element 301 being particularly configured so that it may be formed of a polymeric or "plastic" material. The latching element 301 has similarities to the latching element 96 including a substantially similar body member 303 which corresponds to the body member 89 of the latching element 96 as particularly seen in FIG. 16. A ramp 305 is formed within the body member 303 and corresponds functionally to the lance 91 described relative to the latching element 96. Since the latching element 301 would be molded from a "plastic" material, the ramp 305 would be molded rather than stamped as is the case with the lance 91. The body member 303 terminates at its upper end with a plate 307 from which an upper leg 309 of a U-shaped element extends, lower leg 313 being free to be displaced toward and away from the upper leg 309 since the lower leg 313 is not connected to the plate 307. Notches 315 are formed in the plate 307 on either side of the body member 303 at the juncture of the body member 303 with the plate 307. The body member 303 further terminates at its upper end in a centrally disposed connecting element 317 having a base 319 which is effectively formed integrally with a portion of the upper leg 309, the connecting element 317 having a free end 321 which is discontinuous with the leg 309 to form a channel 323 between the free end 321 of the connecting element 317 and a facing surface of the leg 309. The U-shaped element 311 is compressed and is capable of receipt within one of the openings 301 in the bar 21 in a manner similar to that described for the latching element 96. However, portions of the body portion of the bar 21 adjacent an upper edge of the opening 31 would be received within the channel 323 to provide stability to the mounting of the latching element 301 to the bar 21.

At the opposite end of the body member 303, an extension element 325 and a plate 327 function similarly to the extension element 123 in the plate 125 of the latching element 96 as aforesaid. The plate 327 has molded thereto an actuation plate 329 which functions in a manner essentially identically to the function of the actuation plate 129 of the latching element 96 as described hereinabove. The latching element 301 can be employed in those situations where a plastic latching element would appear to be preferable.

The door frame 14 in assembled relationship with the housing assembly 12 acts to block light leakage from any reasonable line of sight at the juncture of the door frame 14 and the housing assembly 12. The door frame 14 of the invention thereby exhibits multiple connection functions while also providing the function of a light trap per se. The element 174 described in the copending patent application filed of even date described hereinabove also facilitates the light trapping function.

It is to be understood that the invention can be configured other than as is described explicitly herein. Accordingly, while the invention has been described explicitly in reference to a preferred embodiment thereof, it is to be understood that the invention can be practiced other than as described with the scope of the invention being limited only by the scope of the appended claims.

What is claimed is:

1. A lighting fixture having at least one lamp carried within a housing assembly, comprising:

a door frame mounted for movement relative to the housing assembly to facilitate access to the interior of the lighting fixture, portions of the housing assembly defining a recess dimensioned to receive the door frame thereinto;

a lighting panel carried by the door frame and disposed in operative relation to the at least one lamp; and, light trap means formed integrally with at least portions of the door frame and cooperating with portions of the housing assembly for minimizing light leakage from the lighting fixture through spaces disposed between the door frame and the housing assembly, the light trap means comprising flange-like extensions formed along side edges of the door frame and extending outwardly of the fixture and in covering relation to interfaces between the door frame and the housing assembly.

2. The lighting fixture of claim 1 wherein the door frame is formed of elongated bar elements joined together at end portions thereof and further comprising means integral with the bar elements for joining said bar elements together.

3. The lighting fixture of claim 1 wherein the lighting panel comprises a prismatic lens cover.

4. The lighting fixture of claim 1 and further comprising means carried by the door frame and cooperating with slots formed in the housing assembly for hinging the door frame to the housing assembly.

5. The lighting fixture of claim 1 and further comprising means carried by the door frame and cooperating with slots formed in the housing assembly for latching the door frame to the housing assembly.

6. The lighting fixture of claim 5 wherein the latching means comprise at least one spring-like body element receivable within one of the slots and a manually manipulable plate element joined to the body element and extending externally of the lighting fixture at a locus of the door frame, manipulation of the plate element causing disengagement of the body element carried by the door frame from the slot formed in the housing assembly, thereby to release the door frame from the housing assembly on at least one side of the door frame.

7. The lighting fixture of claim 4 wherein the hinging means comprise a body element extending from connection to the door frame, the body element having a predetermined width and an elongated tab terminating the body element and having a length greater than the width of the body element, the slot having an upper portion formed of dimensions capable of receiving the elongated tab thereinto and a lower portion having a width less than the length of the tab and being slightly greater than the width of the body element, the body element being fitted into the lower portion of the slot after insertion of the tab through the upper portion of the slot, the tab being of a length which is too great to fit through the lower portion of the slot, thereby mounting the hinge means within the slot for movement of the door frame about an edge thereof joined to the housing assembly by said hinge means.

8. The lighting fixture of claim 2 wherein the joining means comprise a first tab formed at each end of a first pair of the bar elements, each tab surmounting a slot formed along the juncture between the tab and the bar elements, the other pair of parallel bar elements having a second tab formed at each end thereof, the second tabs being dimensioned to be received one each through the slots at the ends of the first pair of the bar elements, the first and second tabs being bent back over to connect the bar elements together.

9. The lighting fixture of claim 8 wherein the bar elements comprise a central body portion, a flange extending from one side edge of the central body portion, and a first U-shaped flange extending from the other side of the central body portion, the first U-shaped flange terminating in a second U-shaped flange on the opposite side of the central body portion from which the flange and the first U-shaped flange extend, the outermost legs of the second U-shaped flange being an extension of the outermost leg of the second U-shaped flange, thereby providing spaces between legs of the U-shaped flanges.

10. The lighting fixture of claim 9 and further comprising a corner strengthening plate having legs extending at 90° angles relative to each other, one each of the legs being received within the spaces between the first and second U-shaped flanges formed on ends of adjacent bars of the door frame, the plate acting to strengthen a corner joint formed by mounting together of the ends of said adjacent bar elements.

11. The lighting fixture of claim 9 wherein ends of the bar elements are intended to allow fitting of said bar elements together at 90° angles relative to each other.

12. The lighting fixture of claim 10 wherein the second U-shaped flanges formed along side edges of the bar elements extend into covering relation to interfaces between the door frame and the housing assembly, thereby producing a light trap function.

13. The lighting fixture of claim 1 and further comprising clip means attachable to the housing assembly for preventing light from leaking between certain portions of the door frame and the housing assembly.

14. A lighting fixture having at least one lamp carried within a housing assembly, comprising:

a door frame mounted for movement relative to the housing assembly to facilitate access to the interior of the lighting fixture;

a lighting panel carried by the door frame and disposed in operative relation to the at least one lamp;

light trap means formed integrally with at least portions of the door frame for minimizing light leakage from the lighting fixture through spaces disposed between the door frame and the housing assembly; and, means carried by the door frame and cooperating with slots formed in the housing assembly for latching the door frame to the housing assembly, the latching means comprising at least one spring-like body element receivable within one of the slots and a manually manipulable plate element joined to the body element and extending externally of the lighting fixture at a locus of the door frame, manipulation of the plate element causing disengagement of the body element carried by the door frame from the slot formed in the housing assembly, thereby to release the door frame from the housing assembly on at least one side of the door frame.

15. The lighting fixture of claim 14 wherein the door frame is formed of elongated bar elements joined together at end portions thereof and further comprising means integral with the bar elements for joining said bar elements together.

16. The lighting fixture of claim 14 wherein portions of the housing assembly define a recess dimensioned to receive the door frame thereinto, the light trap means comprising flange-like extensions formed along side edges of the door frame and extending outwardly of the fixture and in covering relation to interfaces between the door frame and the housing assembly.

17. The lighting fixture of claim 14 wherein the lighting panel comprises a prismatic lens cover.

18. The lighting fixture of claim 14 and further comprising means carried by the door frame and cooperating with slots formed in the housing assembly for hinging the door frame to the housing assembly.

19. The lighting fixture of claim 18 wherein the hinging means comprise a body element extending from Connection to the door frame, the body element having a predetermined width and an elongated tab terminating the body element and having a length greater than the width of the body element, the slot having an upper portion formed of dimensions capable of receiving the elongated tab thereinto and a lower portion having a width less than the length of the tab and being slightly greater than the width of the body element, the body element being fitted into the lower portion of the slot after insertion of the tab through the upper portion of the slot, the tab being of a length which is too great to fit rough the lower portion of the slot thereby mounting the hinge means within the slot for movement of the door frame about an edge thereof joined to the housing assembly by said hinge means.

20. The lighting fixture of claim 15 wherein the joining means comprise a first tab formed at each end of the first pair of the bar elements, each tab surmounting a slot formed along the juncture between the tab and the bar elements, the other pair of parallel bar elements having a second tab formed at each end thereof the second tabs being dimensioned to be received one each through the slots at the ends of the first pair of the bar elements, the first and second tabs being bent back over to connect the bar elements together.

21. The lighting fixture of claim 20 wherein the bar elements comprise a central body portion, a flange extending from one side edge of the central body portion, and a first U-shaped flange extending from the other side of the central body portion, the first U-shaped flange terminating in a second U-shaped flange on the opposite side of the central body portion from which the flange and the first U-shaped flange extend, the outermost legs of the second U-shaped flange being an extension of the outermost leg of the second U-shaped flange, thereby providing spaces between legs of the U-shaped flanges.

22. The lighting fixture of claim 21 and further comprising a corner strengthening plate having legs extending at 90° angles relative to each other, one each of the legs being received within the spaces between the first and second U-shaped flanges formed on ends of adjacent bars of the door frame, the plate acting to strengthen a corner joint formed by mounting together of the ends of said adjacent bar elements.

23. The lighting fixture of claim 11 wherein end of the bar elements are intended to allow fitting of said bar elements together at 90° angles relative to each other.

24. The lighting fixture of claim 22 wherein the second U-shaped flanges formed along side edges of the bar elements extend into covering relation to interfaces between the door frame and the housing assembly, thereby producing a light trap function.

25. A lighting fixture having at least one lamp carried within a housing assembly, comprising:

a door frame mounted for movement relative to the housing assembly to facilitate access to the interior of the lighting fixture;

a lighting panel carried by the door frame and disposed in operative relation to the at least one lamp;

light trap means formed integrally with at least portions of the door frame for minimizing light leakage from the lighting fixture through spaces disposed between the door frame and the housing assembly; and, means carried by the door frame and cooperating with slots formed in the housing assembly for hinging the door frame to the housing assembly, the hinging means comprising a body element extending from connection to the door frame, the body element having a predetermined width and an elongated tab terminating the body element and having a length greater than the width of the body element, the slot having an upper portion formed of dimensions capable of receiving the elongated tab thereinto and a lower portion having a width less than the length of the tab and being slightly greater than the width of the body element, the body element being fitted into the lower portion of the slot after insertion of the tab through the upper portion of the slot, the tab being of a length which is too great to fit through the lower portion of the slot, thereby mounting the hinge means within the slot for movement of the door frame about an edge thereof joined to the housing assembly by said hinge means.

26. The lighting fixture of claim 25 wherein the door frame is formed of elongated bar elements joined together at end portions thereof and further comprising means integral with the bar elements for joining said bar elements together.

27. The lighting fixture of claim 25 wherein portions of the housing assembly define a recess dimensioned to receive the door frame thereinto, the light trap means comprising flange-like extensions formed along side edges of the door frame and extending outwardly of the fixture and in covering relation to interfaces between the door frame and the housing assembly.

28. The lighting fixture of claim 25 wherein the lighting panel comprises a prismatic lens cover.

29. The lighting fixture of claim 25 and further comprising means carried by the door frame and cooperating with the slots formed in the housing assembly for latching the door frame to the housing assembly.

30. The lighting fixture of claim 29 wherein the latching means comprise at least one spring-like body element receivable within one of the slots and a manually manipulable plate element joined to the body element and extending externally of the lighting fixture at a locus of the door frame, manipulation of the plate element causing disengagement of the body element carried by the door frame from the slot formed in the housing assembly, thereby to release the door frame from the housing assembly on at least one side of the door frame.

31. The lighting fixture of claim 26 wherein the joining means comprise a first tab formed at each end of a pair of the bar elements, each tab surmounting a slot formed along the juncture between the tab and the bar elements, the other pair of parallel bar elements having a second tab formed at each end thereof, the second tabs being dimensioned to be received one each through the slots at the ends of the first pair of the bar elements, the first and second tabs being bent back over to connect the bar elements together.

32. The lighting fixture of claim 31 wherein the bar elements comprise a central body portion, a flange extending from one side edge of the central body portion, and a first U-shaped flange extending from the other side of the central body portion, the first U-shaped flange terminating in a second U-shaped flange on the opposite side of the central body portion from which the flange and the first U-shaped flange extend, the outermost legs of the second U-shaped flange being an extension of the outermost leg of the second U-shaped flange, thereby providing spaces between legs of the U-shaped flanges.

33. The lighting fixture of claim 32 and further comprising a corner strengthening plate having legs extending at 90° angles relative to each other, one each of the legs being received within the spaces between the first and second U-shaped flanges formed on ends of adjacent bars of the door frame, the plate acting to strengthen a corner joint formed by mounting together of the ends of said adjacent bar elements.

34. The lighting fixture of claim 32 wherein ends of the bar elements are intended to allow fitting of said bar elements together at 90° relative to each other.

35. The lighting fixture of claim 33 wherein the second U-shaped flanges formed along side edges of the bar elements extend into covering relation to interfaces between the door frame and the housing assembly, thereby producing a fight trap function.

36. A lighting fixture having at least one lamp carried within a housing assembly, comprising:

a door frame mounted for movement relative to the housing assembly to facilitate access to the interior of the lighting fixture, wherein the door frame is formed of elongated bar elements joined together at end portions thereof;

a lighting panel carried by the door frame and disposed in operative relation to the at least one lamp;

light trap means formed integrally with at least portions of the door frame for minimizing light leakage from the lighting fixture through spaces disposed between the door frame and the housing assembly; and, means integral with the bar elements for joining said bar elements together, the joining means comprising a first tab formed at each end of a first pair of the bar elements, each tab surmounting a slot formed along the juncture between the tab and the bar elements, the other pair of parallel bar elements having a second tab formed at each end thereof, the second tabs being dimensioned to be received one each through the slots at the ends of the first pair of the bar elements, the first and second tabs being bent back over to connect the bar elements together.

37. The lighting fixture of claim 36 wherein portions of the housing assembly define a recess dimensioned to receive the door frame thereinto, the light trap means comprising flange-like extensions formed along side edges of the door frame and extending outwardly of the fixture and in covering relation to interfaces between the door frame and the housing assembly.

38. The lighting fixture of claim 36 wherein the lighting panel comprises a prismatic lens cover.

39. The lighting fixture of claim 1 and further comprising means carried by the door frame and cooperating with slots formed in the housing assembly for hinging a door frame to the housing assembly.

40. The lighting fixture of claim 36 and further comprising means carried by the door frame and cooperating with slots formed in the housing assembly for latching the door frame to the housing assembly.

41. The lighting fixture of claim 40 wherein the latching means comprise at least one spring-like body element receivable within one of the slots and a manually manipulable plate element joined to the body element and extending externally of the lighting fixture at a locus of the door frame, manipulation of the plate element causing disengagement of the body element carried by the door frame from the slot formed in the housing assembly, thereby to release the door frame from the housing assembly on at least one side of the door frame.

42. The lighting fixture of claim 39 wherein the hinging means comprise a body element extending from Connection to the door frame, the body element having a predetermined width and an elongated tab terminating the body element and having a length greater than the width of the body element, the slot having an upper portion formed of dimensions capable of receiving the elongated tab thereinto and a lower portion having a width less than the length of the tab and being slightly greater than the width of the body element, the body element being fitted into the lower portion of the slot after insertion of the tab through the upper portion of the slot, the tab being of a length which is too great to fit through the lower portion of the slot, thereby mounting the hinge means within the slot for movement of the door frame about an edge thereof joined to the housing assembly by said hinge means.

43. The lighting fixture of claim 36 wherein the bar elements comprise a central body portion, a flange extending from one side edge of the central body portion, and a first U-shaped flange extending from the other side of the central body portion, the first U-shaped flange terminating in a second U-shaped flange on the opposite side of the central body portion from which the flange and the first U-shaped flange extend, the outermost legs of the second U-shaped flange being an extension of the outermost leg of the second U-shaped flange, thereby providing spaces between legs of the U-shaped flanges.

44. The lighting fixture of claim 43 and further comprising a corner strengthening plate having legs extending at 90° angles relative to each other, one each of the legs being received within the spaces between the first and second U-shaped flanges formed on ends of adjacent bars of the door frame, the plate acting to strengthen a corner joint formed by mounting together of the ends of said adjacent bar elements.

45. The lighting fixture of claim 43 wherein ends of the bar elements are intended to allow fitting of said bar elements together at 90° angles relative to each other.

46. The lighting fixture of claim 44 wherein the second U-shaped flanges formed along side edges of the bar elements extend into covering relation to interfaces between the door frame and the housing assembly, thereby producing a light trap function.

47. A lighting fixture having at least one lamp carried within a housing assembly, comprising:

a door frame mounted for movement relative to the housing assembly to facilitate access to the interior of the lighting fixture, wherein the door frame is formed of elongated bar elements joined together at end portions thereof;

a lighting panel carried by the door frame and disposed in operative relation to the at least one lamp; and, means integral with the bar elements for joining said bar elements together, the joining means comprising a first tab formed at each end of a first pair of the bar elements, each tab surmounting a slot formed along the juncture between the tab and the bar elements, the other pair of parallel bar elements having a second tab formed at each end thereof, the second tab being dimensioned to be received one each through the slots at the ends of the first pair of the bar elements, the first and second tabs being bent back over to connect the bar elements together.

48. The lighting fixture of claim 47 wherein portions of the housing assembly define a recess dimensioned to receive the door frame thereinto, the door frame having flange-like extensions formed along side edges thereof and extending outwardly of the fixture and in covering relation to interfaces between the door frame and the housing assembly.

49. The lighting fixture of claim 47 wherein the lighting panel comprises a prismatic lens cover.

50. The lighting fixture of claim 47 and further comprising means carried by the door frame and cooperating with slots formed in the housing assembly for hinging the door frame to the housing assembly.

51. The lighting fixture of claim 47 and further comprising means carried by the door frame and cooperating with slots formed in the housing assembly for latching the door frame to the housing assembly.

52. The lighting fixture of claim 51 wherein the latching means comprise at least one spring-like body element receivable within one of the slots and a manually manipulable plate element joined to the body element and extending externally of the lighting fixture at a locus of the door frame, manipulation of the plate element causing disengagement of the body element carried by the door frame from the slot formed in the housing assembly, thereby to release the door frame from the housing assembly on at least one side of the door frame.

53. The lighting fixture of claim 50 wherein the hinging means comprise a body element extending from connection to the door frame, the body element having a predetermined width and an elongated tab terminating the body element and having a length greater than the width of the body element, the slot having an upper portion formed of dimensions capable of receiving the elongated tab thereinto and a lower portion having a width less than the length of the tab and being slightly greater than the width of the body element, the body element being fitted into the lower portion of the slot after insertion of the tab through the upper portion of the slot, the tab being of a length which is too great to fit through the lower portion of the slot, thereby mounting the hinge means within the slot for movement of the door frame about an edge thereof joined to the housing assembly by said hinge means.

54. The lighting fixture of claim 47 wherein the bar elements comprise a central body portion, a flange extending from one side edge of the central body portion, and a first U-shaped flange extending from the other side of the central body portion, the first U-shaped flange terminating in a second U-shaped flange on the opposite side of the central body portion from which the flange and the first U-shaped flange extend, the outermost legs of the second U-shaped flange being an extension of the outermost leg of the second U-shaped flange, thereby providing spaces between legs of the U-shaped flanges.

55. The lighting fixture of claim 54 and further comprising a corner strengthening plate having legs extending at 90° angles relative to each other, one each of the legs being received within the spaces between the first and second U-shaped flanges formed on ends of the adjacent bars of the door frame, the Ate acting to strengthen a corner joint formed by mounting together of the ends of said adjacent bar elements.

56. The lighting fixture of claim 54 wherein ends of the bar elements are intended to allow fitting of said bar elements together at 90° angles relative to each other.

57. The lighting fixture of claim 55 wherein the second U-shaped flanges formed along side edges of the bar element extending into covering relation to interfaces between the door frame and the housing assembly, thereby producing a light trap function.

58. A lighting fixture having at least one lamp carried within a housing assembly, comprising:

a door frame mounted for movement relative to the housing assembly to facilitate access to the interior of the lighting fixture;

a lighting panel carried by the door frame and disposed in operative relation to the at least one lamp; and, means carried by the door frame and cooperating with slots formed in the housing assembly for latching the door frame to the housing assembly, the latching means comprising at least one spring-like body element receivable within one of the slots and a manually manipulable plate element joined the body element and extending externally of the lighting fixture at a locus of the door frame, manipulation of the plate element causing disengagement of the body element carried by the door frame from the slot formed in the housing assembly, thereby to release the door frame from the housing assembly on at least one side of the door frame.

59. The lighting fixture of claim 58 wherein the door frame is formed of elongated bar elements joined together at end portions thereof and further comprising means integral with the bar elements for joining said bar elements together.

60. The lighting fixture of claim 58 wherein portions of the housing assembly define a recess dimensioned to receive the door frame thereinto, the door frame having flange-like extensions formed along side edges thereof and extending outwardly of the fixture and in covering relation to interfaces between the door frame and the housing assembly.

61. The lighting fixture of claim 58 wherein the lighting panel comprises a prismatic lens cover.

62. The lighting fixture of claim 58 and further comprising means carried by the door frame and cooperating with slots formed in the housing assembly for hinging the door frame to the housing assembly.

63. The lighting fixture of claim 62 wherein the hinging means comprise a body element extending from connection to the doorframe, the body element having a predetermined width and an elongated tab terminating the body element and having a length greater than the width of the body element, the slot having an upper portion formed of dimensions capable of receiving the elongated tab thereinto and a lower portion having a width less than the length of the tab and being slightly greater than the width of the body element, the body element being fitted into the lower portion of the slot after insertion of the tab through the upper portion of the slot, the tab being of a length which is too great to fit through the lower portion of the slot, thereby mounting the hinge means within the slot for movement of the door frame about an edge thereof joined to the housing assembly by said hinge means.

64. The lighting fixture of claim 59 wherein the joining means comprise a first tab formed at each end of a first pair of bar elements, each tab surmounting a slot formed along the juncture between the tab and the bar elements, the other pair of parallel bar elements having a second tab formed at each end thereof the second tabs being dimensioned to be received one each through the slots at the ends of the first pair of the bar elements, the first and second tabs being bent back over to connect the bar elements together.

65. The lighting fixture of claim 64 wherein the bar elements comprise a central body portion, a flange extending from one side edge of the central body portion and a first U-shaped flange extending from the other side of the central body portion, the first U-shaped flange terminating in a second U-shaped flange on the opposite side of the central body portion from which the flange and the-first U-shaped flange extend, the outermost legs of the second U-shaped flange being an extension of the outermost leg of the second U-shaped flange, thereby providing spaces between legs of the U-shaped flanges.

66. The lighting fixture of claim 65 and further comprising a corner strengthening plate having legs extending at 90° angles relative to each other, one each of the legs being received within the spaces between the first and second U-shaped flanges formed on ends of adjacent bars of the door frame, the pate acting to strengthen a corner joint formed by mounting together of the ends of said adjacent bar elements.

67. The lighting fixture of claim 65 wherein ends of the bar elements are intended to allow fitting of said bar elements together at 90° angles relative to each other.

68. The lighting fixture of claim 66 wherein the second U-shaped flanges formed along side edges of the bar element extend into covering relation to interfaces between the doorframe and the housing assembly, thereby producing a light trap function.

69. A lighting fixture having at least one lamp carried within a housing assembly, comprising:

a door frame mounted for movement relative to the housing assembly to facilitate access to the interior of the lighting fixture;

a lighting panel carried by the door frame and disposed in operative relation to the at least one lamp; and, means carried by the door frame and cooperating with slots formed in the housing assembly for hinging the door frame to the housing assembly, the hinging means comprising a body element extending from connection to the door frame, the body element having a predetermined width and an elongated tab terminating The body element and having a length greater than the width of the body element, the slot having an upper portion formed of dimensions capable of receiving the elongated tab thereinto an a lower portion having a width less than the length of the tab and being slightly greater than the width of the body element, the body element being fitted into the lower portion of the slot after insertion of the tab through the upper portion of the slot, the tab being of a length which is too great to fit through the lower portion of the slot, thereby mounting the hinge means within the slot for movement of the door frame about an edge thereof joined to the housing assembly by said hinge means.

70. The lighting fixture of claim 69 wherein the door frame is formed of elongated bar elements joined together at end portions thereof and further comprising means integral with the bar elements for joining said bar elements together.

71. The lighting fixture of claim 69 wherein portions of the housing assembly define a recess dimensioned to receive the door frame thereinto, the door frame having flange-like extensions formed along side edges thereof, the flange-like extensions extending outwardly of the fixture and in covering relation to interfaces between the door frame and the housing assembly.

72. The lighting fixture of claim 69 wherein the lighting panel comprises a prismatic lens cover.

73. The lighting fixture of claim 69 and further comprising means carried by the door frame and cooperating with slots formed in the housing assembly for latching the door frame to the housing assembly.

74. The lighting fixture of claim 73 wherein the latching means comprise at least one spring-like body element receivable within one of the slots and a manually manipulable plate element joined to the body element and extending externally of the lighting fixture at a locus of the door frame, manipulation of the plate element causing disengagement of the body element carried by the door frame from the slot formed in the housing assembly, thereby to release the door frame from the housing assembly on at least one side of the door frame.

75. The lighting fixture of claim 70 wherein the joining means comprise a first tab formed at each end of a first pair of the bar elements, each tab surmounting a slot formed along the juncture between the tab and the bar elements, the other pair of parallel bar elements having a second tab formed at each end thereof, the second tabs being dimensioned to be received one each through the slots at the ends of the first pair of the bar elements, the first and second tabs being bent back over to connect the bar elements together.

76. The lighting fixture of claim 75 wherein the bar elements comprise a central body portion, a flange extending from one side edge of the central body portion and a first U-shaped flange extending from the other side of the central body portion, the first U-shaped flange terminating in a second U-shaped flange on the opposite side of the central body portion from which the flange and the first U-shaped flange extend, the outermost legs of the second U-shaped flange being an extension of the outermost leg of the second U-shaped flange, thereby providing spaces between legs of the U-shaped flanges.

77. The lighting fixture of claim 76 and further comprising a corner strengthening plate having legs extending at 90° angles relative to each other, one each of the legs being received within the spaces between the first and second U-shaped flanges formed on ends of adjacent bars of the door frame, the plate acting to strengthen a corner joint formed by mounting together of the ends of said adjacent bar elements.

78. The lighting fixture of claim 76 wherein ends of the bar elements are intended to allow fitting of said bar elements together at 90° angles relative to each other.

79. The lighting fixture of claim 77 wherein the second U-shaped flanges formed along side edges of the bar elements extend into covering relation to interfaces between the door frame and the housing assembly, thereby producing a light trap function.

* * * * *